US007048563B2

(12) United States Patent
Fukuda et al.

(10) Patent No.: US 7,048,563 B2
(45) Date of Patent: May 23, 2006

(54) WATERPROOF CONNECTOR

(75) Inventors: Masaru Fukuda, Shizuoka (JP); Harunori Tashiro, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 12 days.

(21) Appl. No.: 10/830,323

(22) Filed: Apr. 23, 2004

(65) Prior Publication Data

US 2005/0003708 A1 Jan. 6, 2005

(30) Foreign Application Priority Data

Apr. 23, 2003 (JP) ..... P2003-118641
May 21, 2003 (JP) ..... P2003-143612

(51) Int. Cl.
*H01R 13/52* (2006.01)

(52) U.S. Cl. ..... 439/276; 439/604; 439/417; 439/274

(58) Field of Classification Search ..... 439/276, 439/604, 936, 417, 587, 274, 275, 404, 279
See application file for complete search history.

(56) References Cited

U.S. PATENT DOCUMENTS 3,923,362 A * 12/1975 Dunn et al. ..... 439/200
6,116,952 A * 9/2000 Nakata ..... 439/587

FOREIGN PATENT DOCUMENTS

| | | |
|---|---|---|
| JP | 7-312259 | 11/1995 |
| JP | 10-284170 | 10/1998 |
| JP | 11-121084 | 4/1999 |
| JP | 11-329573 | 11/1999 |

* cited by examiner

*Primary Examiner*—Ross Gushi
(74) *Attorney, Agent, or Firm*—Finnegan, Henderson, Farabow, Garrett & Dunner, L.L.P.

(57) ABSTRACT

A waterproof connector 10 includes a housing 11, a number of connecting terminals 13 respectively inserted into a number of inserting holes 12 provided at the housing 11, a number of press contact blades respectively provided at end portions of the respective connecting terminals 13 and exposed from the housing, and rear cover 15 attached to the housing 11 to cover the respective press contact blades 14, and a seal member filling layer 17 continuous to the inserting hole 12 and capable of containing a seal member 16 for covering the respective press contact blades 14 is provide at a rear portion 11A of the housing 11.

8 Claims, 23 Drawing Sheets

WATERPROOF CONNECTOR

BACKGROUND OF THE INVENTION

1. Field of the Invention

The present invention relates to a waterproof connector, particularly relates to a waterproof connector devised to provide waterproof to a connector for bringing an electric wire into press contact with a press contact blade by breaking a cover of the electric wire by the press contact blade by pressing the electric wire into the press contact blade.

The present invention further relates to a waterproof connector, more in details, relates to a waterproof connector facilitating operation of filling a seal member to a seal member filling layer and capable of waterproofing firmly.

2. Related Art

As shown by FIG. 10(A), generally, an automobile 1100 is provided with left and right headlamps 1102, 1103, left and right direction indicator lamps 1104, 1105 and the like at a front bumper 1101 and is provided with left and right tail lamps 1107, 1108 and the like at a rear bumper 1106.

A wire harness is wired to the headlamps 1102, 1103, the direction indicator lamps 1104, 1105 and the tail lamps 1107, 1108. As an example of wiring the wire harness, a circuit shown in FIG. 10(B) is known.

That is, in a circuit 110 shown in FIG. 10(B), connectors 1111, 1112 for the left and right headlamps are connected to lamp cases of the left and right headlamps 1102, 1103, connectors 1113, 1114 for the left and right direction indicator lamps are connected to lamp cases of the left and right direction indicator lamps 1104, 1105, and connectors 1115, 1116 for the left and right tail lamps are connected to lamp cases of the left and right tail lamps 1107, 1108.

At this occasion, a wire harness 1118 is wired to a portion of the automobile 1100 which is liable to be influenced by water and therefore, waterproof is requested to the connectors 1111 through 1116 and a waterproof connector meeting the request has been proposed, for example, as shown in Japanese Patent 3268945.

According to a waterproof connector 1120 of the publication, as shown by FIG. 12, a housing 1121 is constituted by integrating a main body 1122 and a lid member 1123, and inside of the housing 1121 is inwardly mounted with wire connecting portions 1125A of a plurality of connecting terminals 1125 connected with wire harnesses 1124 and fit to counter side connecting terminals.

At least one of the main body 1122 and the lid member 1123 is provided with partition walls (not illustrated) for partitioning the connecting terminals 1125 in parallel and an adhering member 1127 is filled at vicinities of the wire connecting portions 1125A to thereby provide waterproof between the main body 1122 and the lid member 1123.

Namely, the waterproof connector described above used in the circuit in which a housing 1121 is constituted by a main body 1122 formed with a terminal mounting portion mounted with a connecting terminal 1125 and a lid member 1123, the terminal mounting portion coated with butyl rubber is arranged with the connecting terminal 1125 and the lid member 1125 coated with the butyl rubber is covered thereto to waterproof.

Therefore, it seems that the wire harnesses 1124 can preferably be connected to the left and right headlamps 1102, 1103 and the left and right direction indicator lamps 1104, 1105 provided at the front bumper 1101 and the left and right tail lamps 1107, 1108 provided at the rear bumper 1106 of the automobile 1100 shown in FIG. 10(A) in a waterproof state by using the waterproof connector 1120 of the publication.

Further, there is also a constitution in which a cover made to be openable and closable to a housing is provided, an ultraviolet ray cured resin is filled to the cover, a connecting terminal is inserted into the housing and thereafter, the cover is closed and a clearance thereof is filled by a gel-like ultraviolet ray cured resin in liquid tight, for example, as shown in Unexamined Japanese Patent Publication Hei. 10-284170.

Further, there is disclosed a constitution in which a housing is formed by a main body having a terminal holding portion formed with a terminal containing groove and a cover covering the terminal holding portion, an adhering seal agent is filled to the terminal holding portion and the cover arranged with a connecting terminal and the cover is covered thereto, the housing is oscillated from outside by an ultrasonic wave to thereby cure the adhering seal agent and weld the terminal holding portion and the cover (refer to, for example, as shown in Unexamined Japanese Patent Publication Hei. 11-121084.

Further, there is also known a constitution in which a pair of jelly containing frames are openably and closably provided opposedly to a connecting terminal fitting portion of a connector housing, a connecting terminal is inserted thereto and thereafter, the connecting terminal fitting portion is closed by the pair of jelly containing frames containing a silicone jelly to thereby waterproof, for example, as shown in Unexamined Japanese Patent Publication Hei. 11-329573.

However, according to the circuit 1110 shown in FIG. 10(B), the wire harness 1118 is connected to a main connector 1119, the terminal connectors 1111 through 1116 connected to the lamp cases are connected to the wire harness 1118 and therefore, the circuit 1110 becomes complicated, time and labor for making the circuit 1110 is taken and in recent years, reduction of a wire harness circuit 1130 shown in FIG. 11 to practice has been desired.

According to the wire harness circuit 1130 shown in FIG. 11, press contact blades 1132 are provided to respective connectors 1131, and by pressing wire harnesses 1133 into receiving recess portions of the press contact blades 1132, the wire harnesses 1133 are connected to the press contact blades 1132 by breaking covers of the wire harnesses 1133 by the press contact blades 1132.

Therefore, the wire harnesses 1133 can simply be connected to the press contact blades 1132 and the wire harness circuit 1130 can be made without taking time and labor.

By arranging the respective connectors 1131 of the wire harness circuit to rear face sides of the front bumper 1101 and the rear bumper 1106 to connect to the lamp cases of the left and right headlamps 1102, 1103, the left and right direction indicator lamps 1104, 1105 and the left and right tail lamps 1107, 1108, the left and right headlamps 1102, 1103, the left and right direction indicator lamps 1104, 1105 and the left and right tail lamps 1107, 1108 can be connected to a battery of the automobile.

However, the respective connectors 1131 of the wire harness circuit 1130 shown in FIG. 11 are different from the terminal connectors 1111 through 1116 of the circuit 1116 shown in FIG. 10(B) in structures thereof and therefore, a waterproofing structure used in the connectors 1111 through 1116 shown in FIG. 10(B) is not applicable to the respective connectors 1131 of FIG. 11 as it is.

Therefore, the waterproofing structure constituted by the respective connectors 1131 of the wire harness circuit 1130 shown in FIG. 11 has not yet been reduced to practice and the respective connectors 1131 of the wire harness circuit 1131 which are waterproofed have been desired to be reduced to practice.

That is, all of the waterproof connectors disclosed above are constituted by a structure in which a connecting terminal (for example, male terminal) is fixedly attached to a terminal of an electric wire and fit to a connecting terminal (for example, female terminal) of a counter connector to thereby electrically connect to each other. In contact thereto, the connector used in the wire harness circuit 130 needs to be attachable in a state in which a waterproof connector is connected to a middle portion of each electric wire and each electric wire passes the waterproof connector, that is, in a through state. A waterproof connector attachable with each electric wire in the through state in this way has not been reduced to practice.

Further, according to the waterproof connectors of the prior art disclosed above, waterproof is carried out by injecting a seal member of butyl rubber, an ultraviolet ray cured resin, an adhering seal agent or silicone jelly or the like and thereafter covering the cover or the like and therefore, the seal member is extruded by the cover and there is a drawback of bringing about leakage, extrusion or the like of the seal member. Further, since a position of injecting the seal member is unclear, depending on an operator, a dispersion in a position of coating or an amount of injecting the seal member is liable to be produced and there is a concern that a waterproof function differs for respective products and a product value is deteriorated by extrusion of the seal member such that when the amount of injecting the seal member is small, the seal member is not distributed to a portion which needs to fill and the waterproof function becomes deficient and when the amount of injecting the seal member is large, the outlook is deteriorated by extruding the seal member.

Further, in order to prevent the seal member from being hung, until the seal member is cured, the wire harness cannot be transported to a successive step to handle and there poses a problem that an operational efficiency is poor. Further, a cover is mounted at a final step of integrating steps and therefore, in the meantime, movement of the electric wire, the connecting terminal and a connecting portion thereof is not restricted and when an external force is operated to the electric wire or the like, the electric wire is shifted from a predetermined position or connection of the connecting portion becomes unstable and there is a concern of effecting an adverse influence on the function of the wire harness.

SUMMARY OF THE INVENTION

Therefore, a first object of the invention relates to resolving the above-described problem and is to provide a waterproof connector in which a waterproofing measure can be provided to a press contact connector of a type of bringing an electric wire into press contact with the press contact blade.

A second object thereof to provide a waterproof connector attachable with an electric wire in a through state by bringing the electric wire into press contact with a press contact blade and capable of waterproofing electric wire firmly by simple operation.

The above-described object of the invention is achieved by a waterproof connector provided in comprising a housing, a number of connecting terminals respectively inserted into a number of inserting holes provided at the housing, a number of press contact blades respectively provided at end portions of the respective connecting terminals and exposed from the housing, and a rear cover attached to the housing to cover the respective press contact blades wherein a seal member filling layer continuous to the inserting hole and capable of containing a seal member for covering the respective press contact blades is provided at at least one of the housing and the rear cover.

According to the waterproof connector having the above-described constitution, the seal member filling member capable of containing the seal member for covering the respective press contact blades is provided at at least one of the housing and the rear cover. Therefore, the respective press contact blades can be protected by covering the respective press contact blades by the seal member by filling the seal member into the seal member filling layer.

Further, the above-described object of the invention is achieved by the waterproof connector provided in that the seal member filling layer is provided at the housing and a planer shape of the seal member filling layer is formed to be larger than a shape of an opening of the inserting hole and the seal member is filled up to the inserting hole.

According to the waterproof connector having the above-described constitution, by making the planar shape of the seal member filling layer larger than the shape of the opening of the inserting hole, a stepped difference portion is formed at a boundary between the seal member filling layer and the inserting hole.

Therefore, when the seal member is filled only to the seal member filling layer, in the case of exerting a drawing force to the respective contact blades, there is a concern of stripping the seal member off the stepped difference portion. Hence, the seal member is prevented from being stripped off the stepped difference portion by filling the seal member up to the inserting hole.

Further, the above-described object of the invention is achieved by the waterproof connector provided in that the seal member filling layer is provided on a front side of a rear end of the housing and respective electric wires can be bent by bringing the respective electric wires into press contact with the respective press contact blades to connect in the seal member filling layer.

According to the waterproof connector having the above-described constitution, the respective press contact blades and the respective electric wires can firmly be immersed into the seal member by bringing the respective electric wires into press contact with the respective press contact blades in the seal member filling layer and bending the respective electric wires.

Further, the above-described object of the invention is achieved by the waterproof connector provided in that the seal member filling layer is provided by a wall surrounding the respective press contact blades and end portions of the respective electric wires can be contained between an inner side face of the housing and the wall.

According to the waterproof connector having the above-described constitution, end portions of the respective electric wires can be immersed into the seal member by containing the end portions of the respective electric wires between the inner side face of the housing and the wall.

Further, the above-described object of the invention is achieved by the waterproof connector provided in that the respective press contact blades are oriented to open to the rear cover.

According to the waterproof connector having the above-described constitution, the respective press contact blades can be directed to an opening of the seal member filling layer by opening the respective press contact blades to the rear cover. Therefore, middle portions of the electric wires can simply be brought into press contact with the press contact blades from the opening of the seal member filling layer without taking time and labor.

In this way, the waterproof connector can be connected to the middle portions of the respective electric wires and the respective electric wires can be attached thereto in a state of passing the respective electric wires to the waterproof connector, that is, a through state.

In order to achieve a second object, a waterproof connector according to the invention is provided in a waterproof connector comprising a housing provided with a number of inserting holes, a number of connecting terminals one end of each of which is formed with a press contact blade and other end of each of which is formed with an electric contact portion and which are inserted into the inserting holes, and a rear cover mounted to the housing for covering the respective press contact blades:

wherein the housing is provided with a seal member filling layer capable of containing a seal member for covering the respective press contact blades, the rear cover is mounted to the housing to close an opening portion of the seal member filling layer, and the seal member filling layer is provided with a seal member injecting hole for filling the seal member to the seal member sealing layer.

According to the waterproof connector having the above-described constitution, the housing provided with the inserting hole for inserting the connecting terminal formed with the press contact blade is formed with the seal member filling layer capable of containing the seal member for covering the press contact blade, the rear cover formed with the seal member injecting hole is mounted to the housing, the opening portion of the seal member filling layer is closed and therefore, the electric wire can be wired in a through state by pressing the electric wire to the press contact blade of the connecting terminal arranged at inside of the seal member filling layer to be brought into press contact therewith. Further, after closing the opening portion of the seal member filling layer by the rear cover, the seal member can be filled from the seal member injecting hole into the seal member filling layer. Thereby, the press contact blade wired with the electric wire in the through state is covered by the seal member to subject to a waterproof treatment, the press contact blade and the press contact portion can firmly be protected and reliability of a state of brining the electric wire into press contact with the connecting terminal (press contact blade) can be promoted.

Further, control of an amount of filling the seal member is facilitated, the seal member can be prevented from being leaked or extruded from the seal member filling layer and a stable waterproof function can be achieved by eliminating a dispersion in the waterproof function. Further, after curing the seal member, the rear cover is bonded with the seal member and is difficult to be stripped off and therefore, the reliability of the press contact is promoted by protecting the portion of bringing the electric wire into press contact with the connecting terminal (press contact blade) and the press contact portion can firmly be sealed.

Further, the rear cover is arranged to the opening portion of the seal member filling layer to close the opening portion and therefore, the rear cover protects the seal member filled in the seal member filling layer and the seal member can be prevented from being scattered. Thereby, even before the seal member is completely cured, the waterproof connector can be transported to a successive step to carry out operation and an operational efficiency can be promoted.

Further, the rear cover is mounted to the housing immediately after bringing the electric wire into press contact with the connecting terminal (press contact blade) and therefore, even when a force is operated to the electric wire from outside before filling the seal member, the press contact portion can be protected and highly reliable wiring can be carried out.

Further, according to a third aspect of the present invention, a waterproof connector according to the invention is provided in a waterproof connector comprising a housing provided with a number of inserting holes, a number of connecting terminals one end of each of which is formed with a press contact blade and other end of each of which is formed with an electric contact portion and which are inserted into the inserting holes, and a rear cover mounted to the housing for covering the respective press contact blades:

wherein the housing is provided with a seal member filling layer capable of containing a seal member for covering the respective press contact blades, the rear cover comprises a main body portion formed with an opening hole and mounted to the housing, and a lid member fitted to the opening hole for closing the opening hole, and the seal member is made to be able to fill from the opening hole to the seal member filling layer.

According to the waterproof connector having the above-described constitution, the rear cover mounted to the opening portion of the seal member filling layer is constituted by the main body portion formed with the opening hole and the lid member fixed to the opening hole for closing the opening hole, the seal member is made to be able to fill from the opening hole to the seal member filling layer and therefore, after brining the electric wire into press contact with the press contact blade of the connecting terminal, the main body portion of the rear cover is immediately mounted to the housing to fix the electric wire and the press contact portion can be protected against a force from outside. Further, after optically observing a state in the seal member filling layer (press contact state of the electric wire or the like) from the opening hole of the rear cover to confirm to be normal, the seal member can be filled from the opening hole and highly reliable operation can be carried out. Further, after filling the seal member, the opening hole is closed by the lid member and therefore, an effect similar to that described above can be achieved.

Further, according to a fourth aspect of the present invention, the waterproof connector according to the invention is the waterproof connector described in the third aspect of the present invention, provided in that the lid member of the rear cover is provided with a seal member injecting hole for filling the seal member to the seal member filling layer.

According to the waterproof connector having the above-described constitution, the rear cover is constituted by the main body portion and the lid member, the lid member is provided with the seal member injecting hole for filling the seal member and therefore, the seal member can be filled from the seal member injecting hole provided at the lid member into the seal member filling layer by mounting the rear cover to the housing in which the electric wire is brought into press contact with the connecting terminal and closing the opening hole of the rear cover by the lid member. Thereby, the seal member can be filled to an entire region of the seal member filling layer and waterproof can firmly be carried out by filling the seal member into the closed seal member filling layer.

Further, according to a fifth aspect of the present invention, the waterproof connector according to the invention is the waterproof connector according to any one of the second aspect through the fourth aspect, provided in that the seal member is foamed urethane.

According to the waterproof connector having the above-described constitution, the seal member is constituted by foamed urethane and therefore, the waterproof function can be promoted by firmly filling foamed urethane to an entire region of the seal member filling layer by filling foamed urethane into the seal member filling layer the opening portion of which is closed by the rear cover to foam.

DETAILED DESCRIPTION OF THE PREFERRED EMBODIMENTS

A detailed explanation will be given of a waterproof connector according to an embodiment of the invention in reference to the attached drawings as follows.

First Embodiment

Figure 1:
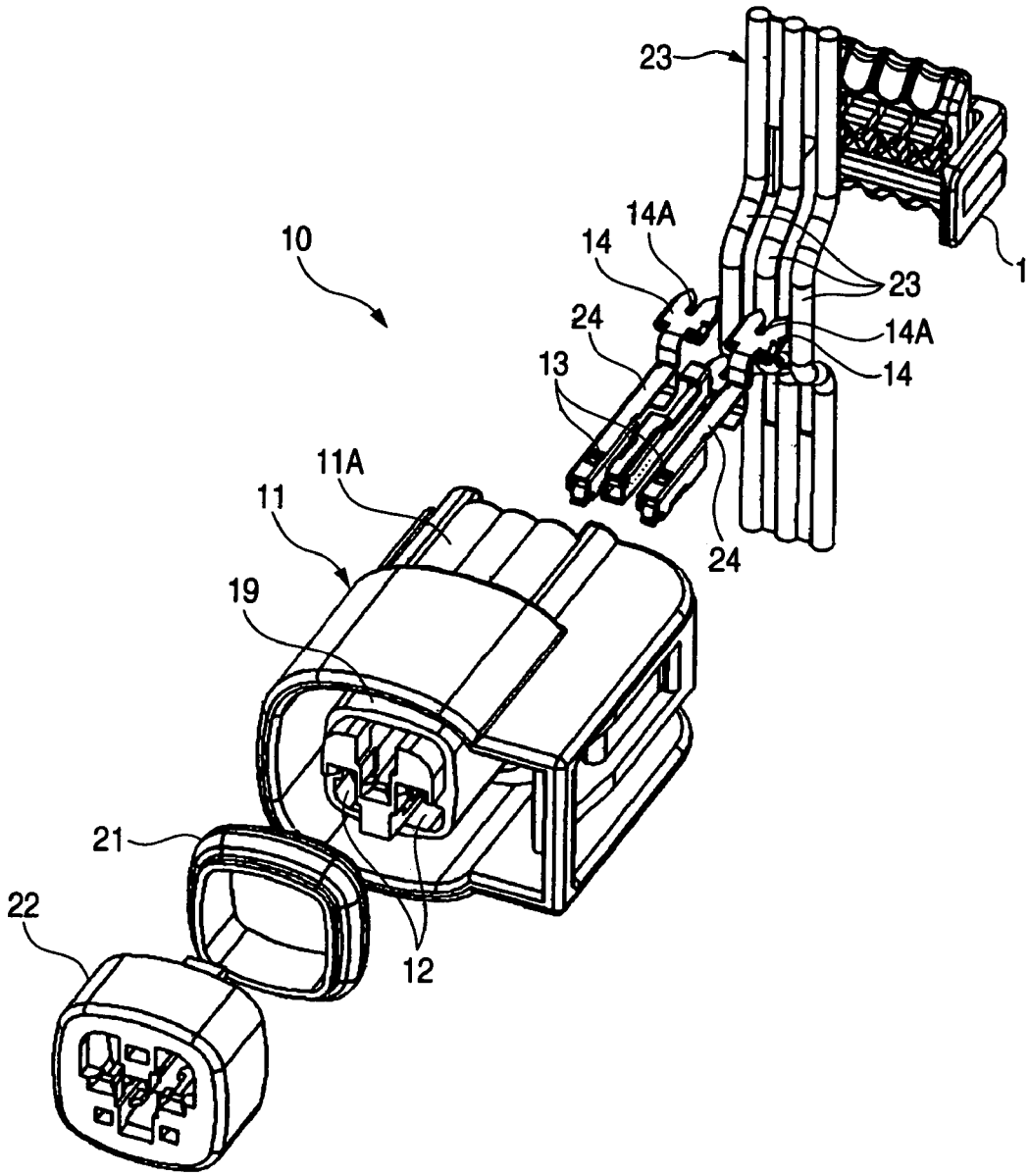
FIG. 1 is a disassembled perspective view of a waterproof connector according to a first embodiment of the present invention.
Figure 2:
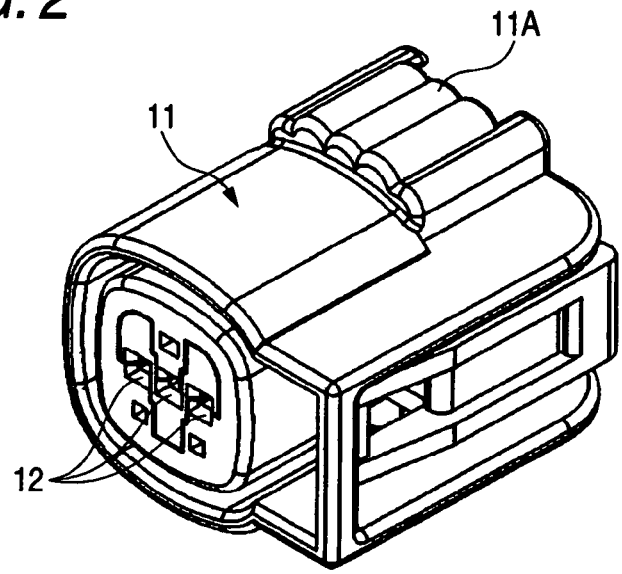
FIG. 2 is a front perspective view showing a state of integrating a packing, a front cover and the like to a housing of the waterproof connector according to the invention.
Figure 3:
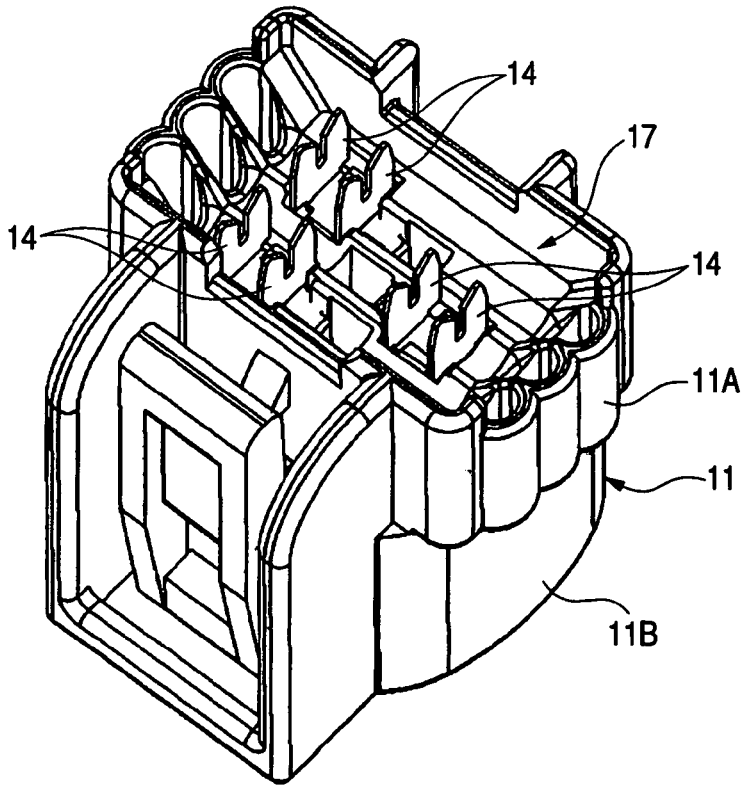
FIG. 3 is a rear perspective view showing a state of integrating a connecting terminal and press contact blades to the housing of the waterproof connector according to the invention.

As shown by FIG. 1 through FIG. 3, a waterproof connector 10 of the first embodiment is provided with a housing 11, a number of connecting terminals 13 respectively inserted into a number of inserting holes 12 provided at the housing 11, a number of press contact blades 14 respectively provided at end portions of the respective connecting terminals 13 and exposed from the housing, and a rear cover 15 attached to the housing 11 to cover the respective press contact blades 14 and a seal member filling layer 17 (refer to FIG. 3) capable of containing a seal member 16 (refer to FIG. 6 through FIG. 9) continuous to the inserting holes 12 and covering the respective press contact blades 14 is provided at a rear portion 11A of the housing 11.

The housing 11 is formed substantially in a rectangular parallelepiped by an insulating resin, the plurality of inserting holes 12 are provided at inside thereof, the rear portion 11A is formed to be able to attach the rear cover 15, a front portion 11B is formed with an inner cylinder portion 19, the inner cylinder portion 19 is fit with a packing 21 for waterproof and attached with a front cover 22 (refer to FIG. 6 through FIG. 9).

In addition thereto, as shown by FIG. 3, the housing 11 is formed with the seal member filling layer 17, that is, a containing recess portion capable of containing a flat electric wire 23 (seal member filling layer 17) at the rear portion 11A and the press contact blade 14 is exposed to the seal member filling layer 17.

The connecting terminal 13 is a conductive member formed substantially in a cylindrical shape to be able to insert into the inserting hole 12. A connecting portion 24 is extended from the end portion of the connecting terminal 13 and an end portion of the connecting portion 24 is provided with a pair of the press contact blades 14.

By inserting the connecting terminal 13 into the inserting hole 12, the press contact blade 14 is exposed to a side of the rear portion 11A of the housing 11, that is, the seal member filling layer (refer to FIG. 3).

The pairs of press contact blades 14 are formed with receiving recess portions 14A into which respective electric wires 23A of the flat electric wire 23 are pressed. By pressing the electric wire 23A into the receiving recess portion 14A, a cover of the electric wire 23A is broken by the press contact blade 14 and the electric wire 23A is brought into press contact with the press contact blade 14.

The respective press contact blades 14 are oriented such that the receiving recess portions 14A are opened to the rear cover 15. Therefore, the respective press contact blades 14 can be directed to an opening of the seal member filling layer 17.

Thereby, a middle portion of the electric wire 23A can simply be pressed from the opening of the seal member filling layer 17 into the receiving recess portion 14A of the press contact blade 14 and therefore, the electric wire 23A can simply be brought into press contact with the press contact blade 14 without taking time and labor.

In this way, the waterproof connector 10 can be connected to middle portions of the respective electric wires 23A and the respective electric wires 23A can be attached thereto in a state of passing the waterproof connector 10, that is, in a through state.

Figure 4:
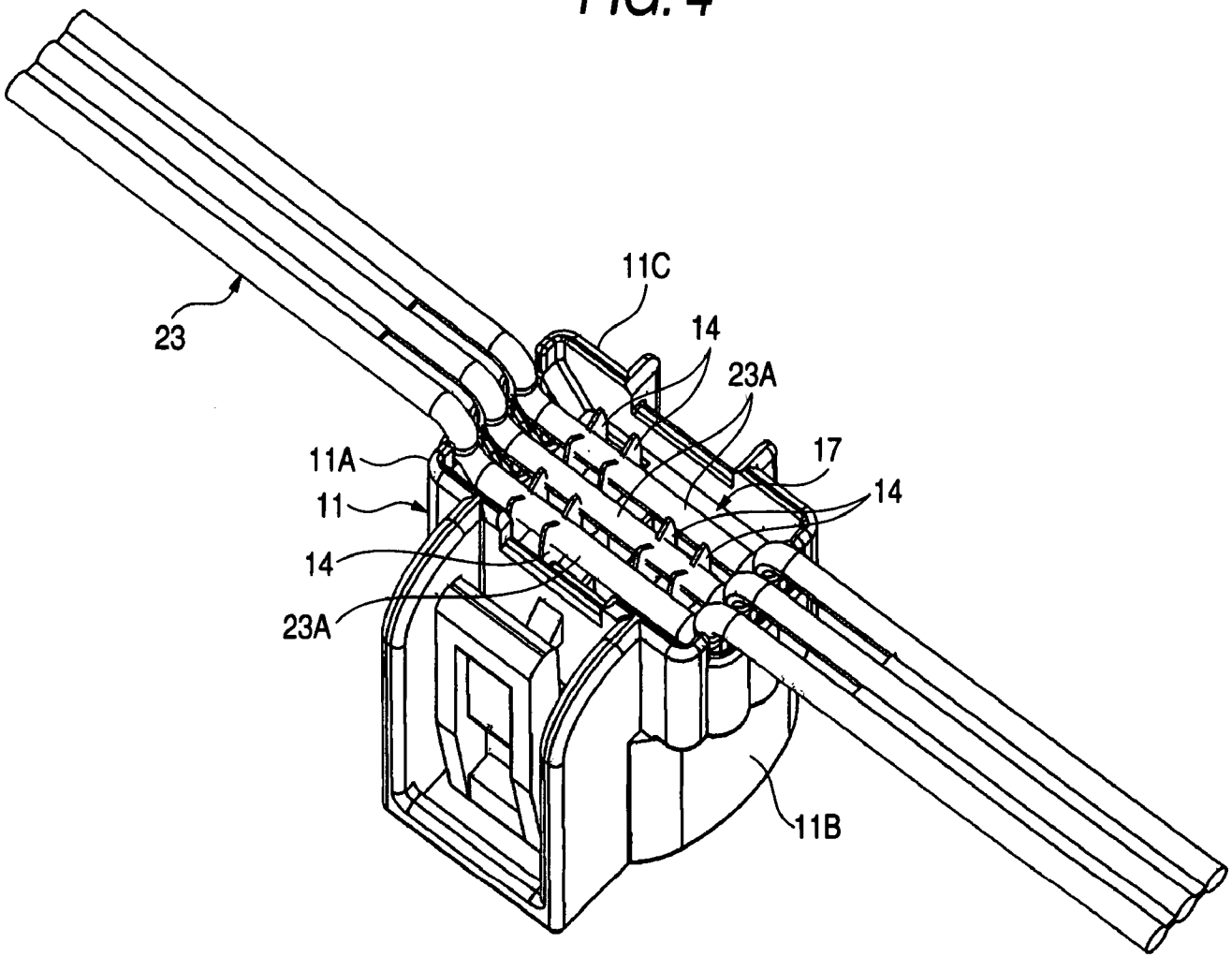
FIG. 4 is a rear perspective view showing a state of bringing a flat electric wire into press contact with the press contact blade of the waterproof connector according to the invention.
Figure 5:
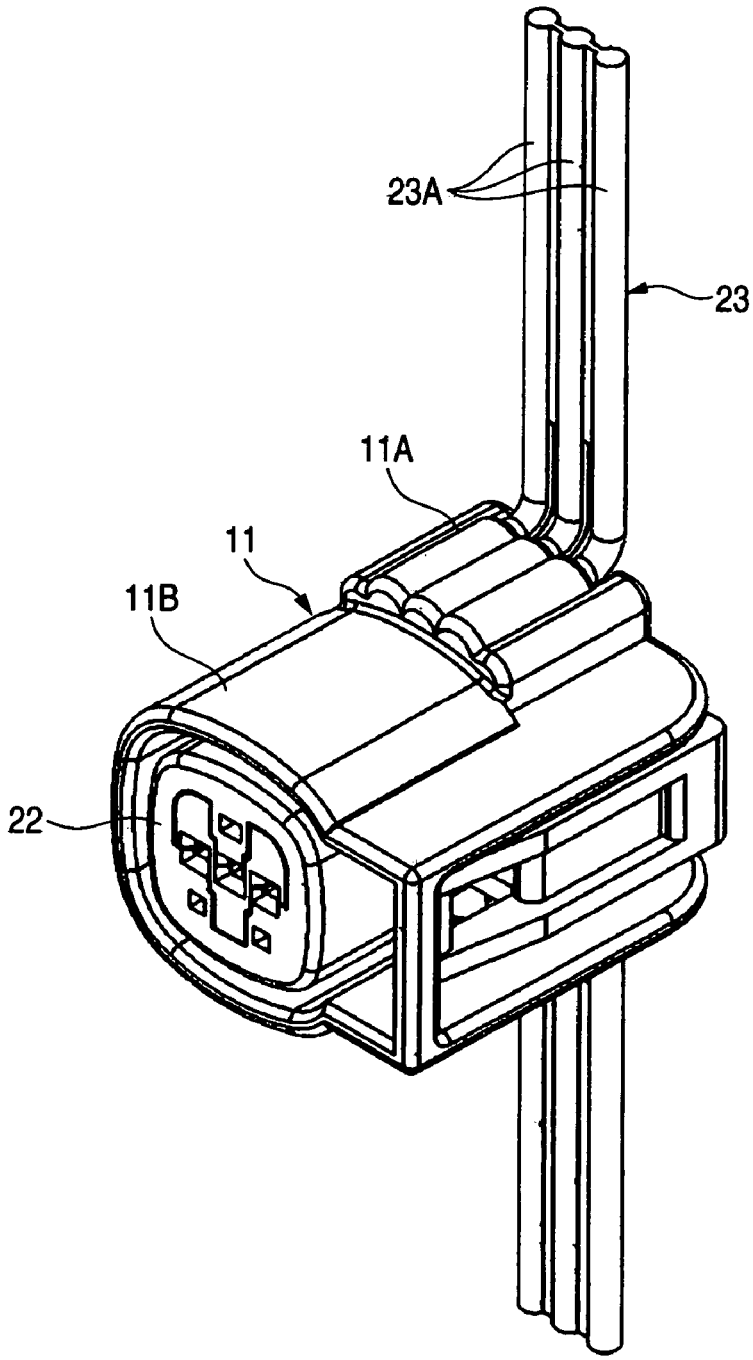
FIG. 5 is a front perspective view showing a state of bringing the flat electric wire into press contact with the press contact blade of the waterproof connector according to the invention.

As shown by FIG. 4 through FIG. 5, by bringing the respective electric wires 23A of the flat electric wire 23 into press contact with the press contact blades 14, the flat electric wire 23 can be contained in the seal member filling layer 17 of the housing rear portion 11A. By filling the seal member 16 (refer to FIG. 6 through FIG. 9) into the seal member filling layer 17 under the state, the seal member 16 can be stored at inside of the seal member filling layer 17 and the respective electric wires 23A brought into press contact with the press contact blades 14 can be immersed into the seal member 16.

The flat electric wire 23 is an electric wire formed in a shape of a ribbon by bundling the plurality of electric wires 23A in a strip-like shape.

Here, arrangement of the flat electric wire 23 (respective electric wires 23A) in the through state signifies a state in which the flat electric wire 23 is extended from both sides of the seal member filling layer 17, that is, a state in which the flat electric wire 23 passes the seal member 16.

Figure 6:
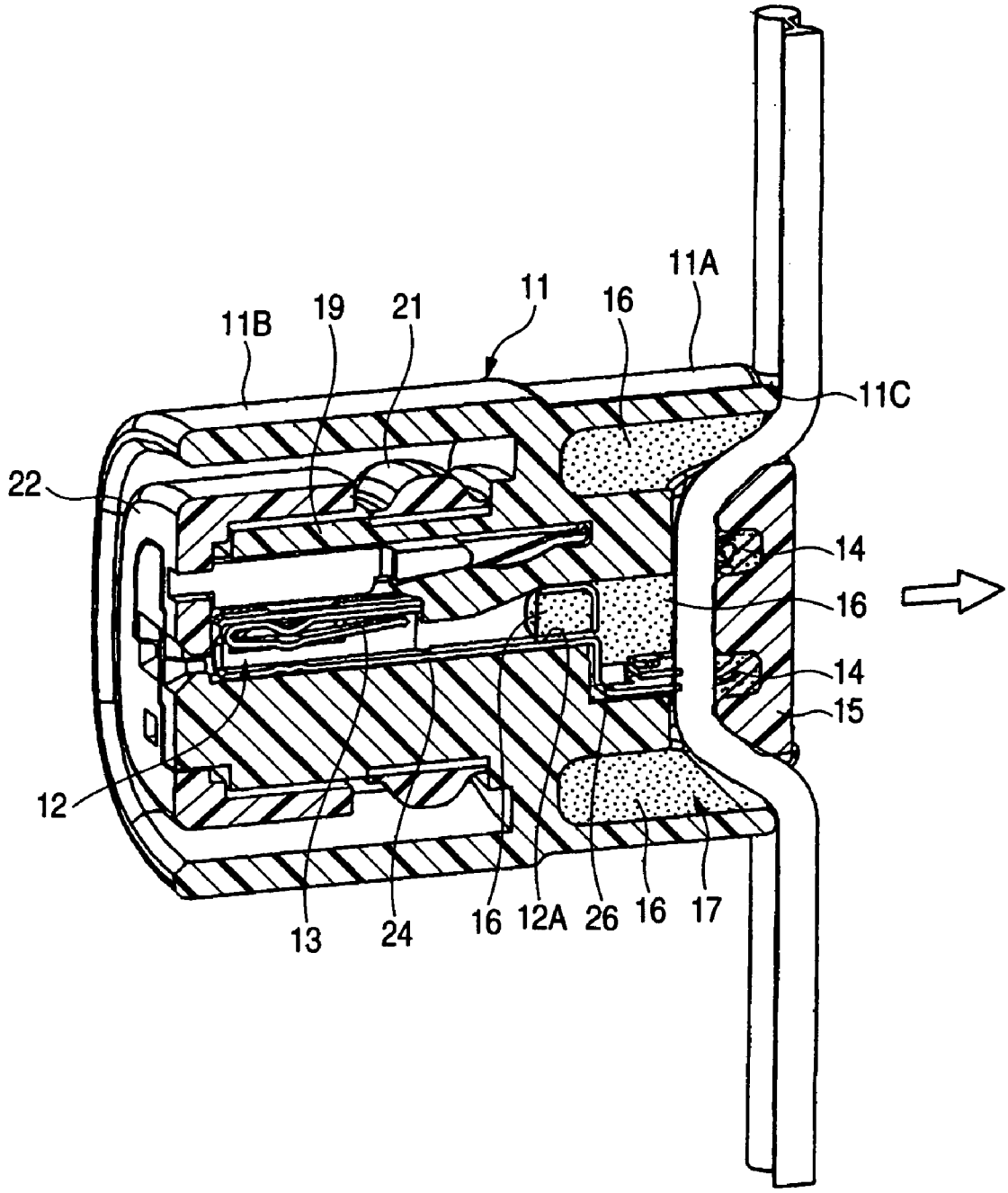
FIG. 6 is a sectional perspective view showing an example of wiring the flat electric wire to the waterproof connector according to the invention in a through state.
Figure 7:
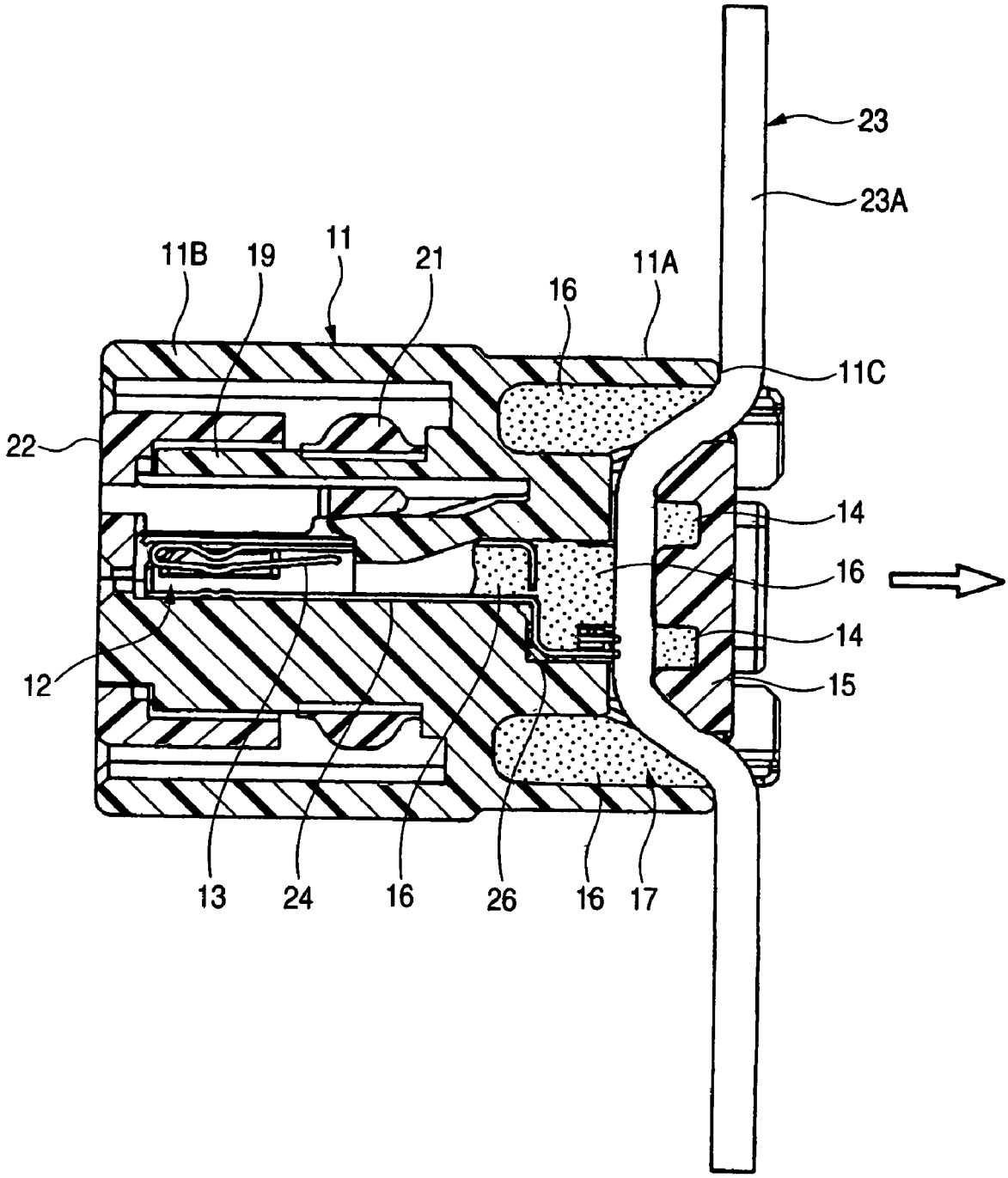
FIG. 7 is a sectional view showing an example of wiring the flat electric wire to the waterproof connector according to the invention in the through state.

As shown by FIG. 6 through FIG. 7, the seal member filling layer 17 is provided at the housing 11 and a planar shape of the seal member filling layer 17 is formed to be larger than the shape of the opening of the inserting hole 12. Further, the seal member 16 filled in the seal member filling layer 17 is filled up to the inserting hole 12.

An explanation will be given here of reason of filling the seal member 16 from the seal member filling layer 17 to the inserting hole 12.

That is, by making the planer shape of the seal member filling layer 17 formed at the housing 11 larger than the shape of the opening of the inserting hole 12, a stepped difference portion 26 is formed at a boundary between the seal member filling layer 17 and the inserting hole 12.

Therefore, when the seal member 16 is filled only to the seal member filling layer 17, in the case in which the respective press contact blades 14 are operated with a drawing force in an arrow mark direction, the seal member 16 is exerted with a force of stripping off the stepped difference portion 26 and there is a concern on stripping the seal member 16 off the stepped difference portion 26.

Hence, the seal member 16 is filled to a middle of the inserting hole 12, that is, to a side of a rear end 12A of the inserting hole 12.

Thereby, when the respective press contact blades 14 are operated with the drawing force in the arrow mark direction, the seal member 16 and the rear end 12A of the inserting hole 12 are only exerted with a shear force and therefore, the seal member 16 can be prevented from stripping off the rear end 12A of the inserting holes 12.

Further, as has been explained in reference to FIG. 4 through FIG. 5, the seal member filling layer 17 is provided on a front side of a rear end 11C of the housing 11 and at inside of the seal member filling layer 17, the respective electric wires 23A can be bent along the seal member filling layer 17 by pressing the respective electric wires 23A into the receiving recess portions 14A of the respective press contact blades in a state of being brought into press contact to connect therewith.

In this way, by bringing the respective electric wires 23A into press contact with the respective press contact blades 14 at inside of the seal member filling layer 17 to connect and bending the respective electric wires 23A along the seal member filling layer 17, when the seal member 16 is filled into the seal member filling layer 17, the respective electric wires 23A can firmly be immersed into the seal member 16.

Further, by providing the rear cover 15, the seal member 16 can be protected by the rear cover 15 and the seal member 16 can be prevented from being scattered by the rear cover 15.

Here, as the seal member 16, UV hardened rubber, RTV silicone (one solution, two solutions types), foamed urethane, hot melt or the like correspond thereto.

Figure 8:
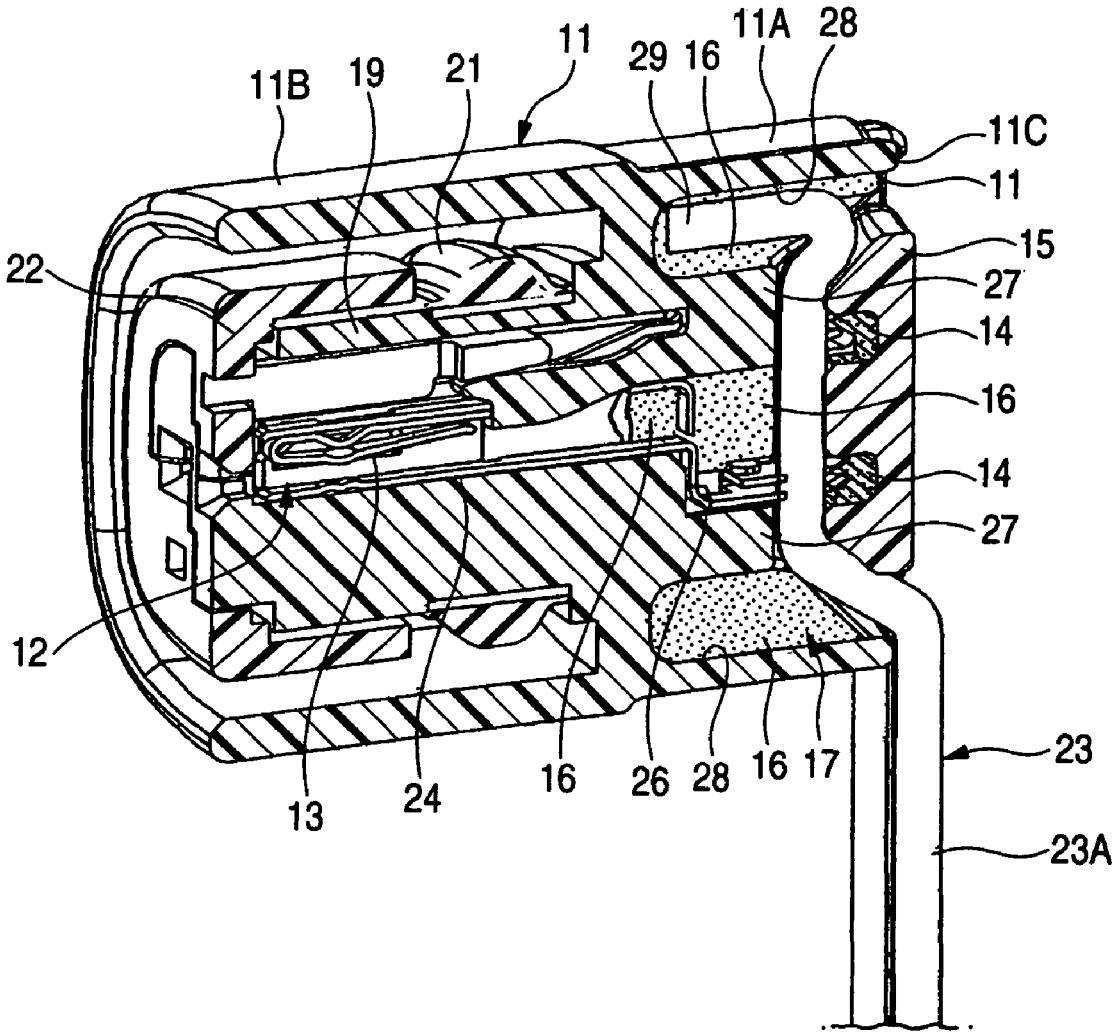
FIG. 8 is a sectional perspective view showing an example of containing an end portion of the flat electric wire to the waterproof connector according to the invention.
Figure 9:
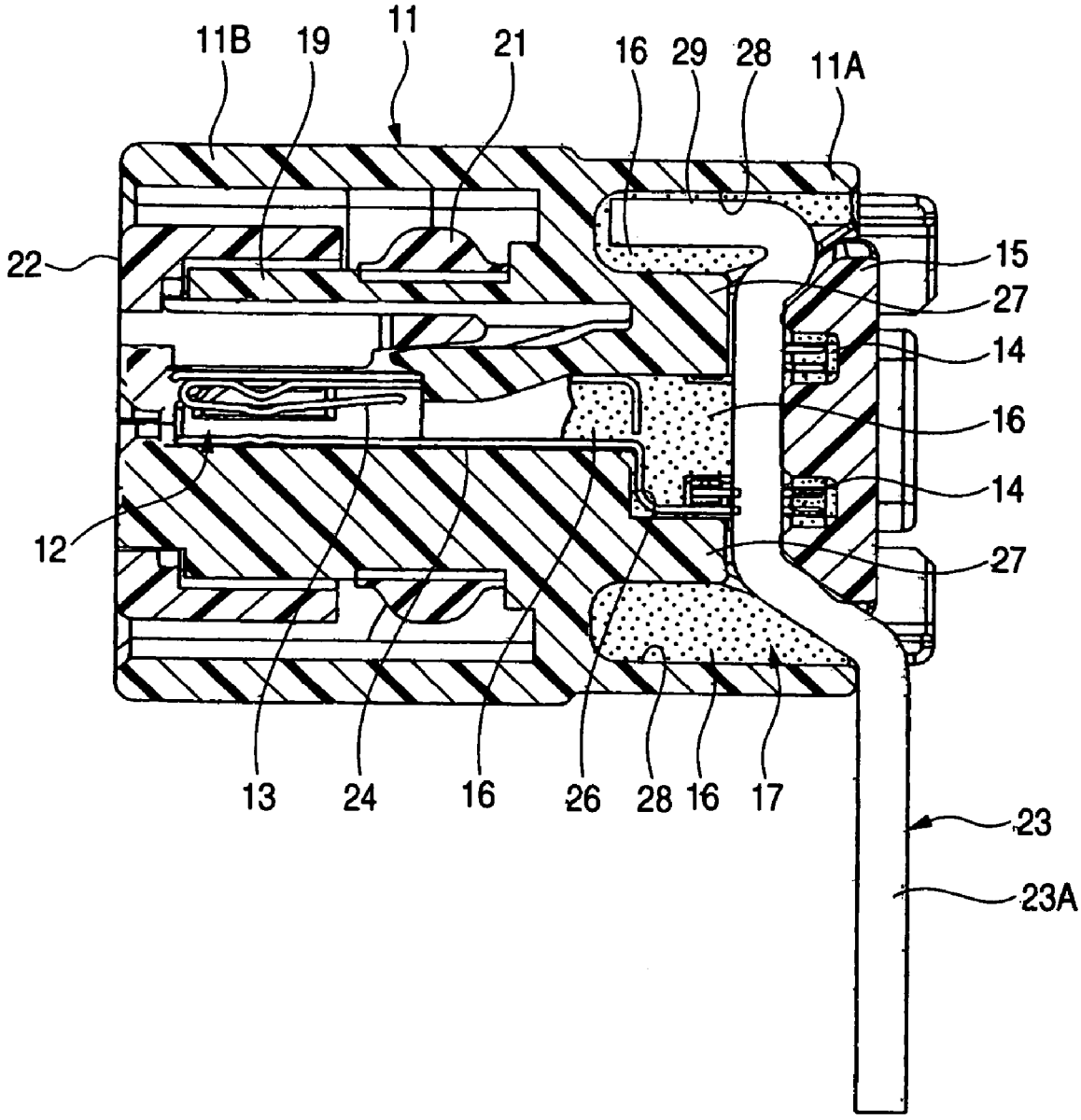
FIG. 9 is a sectional view showing the example of containing the end portion of the flat electric wire to the waterproof connector according to the invention.
Figure 10:
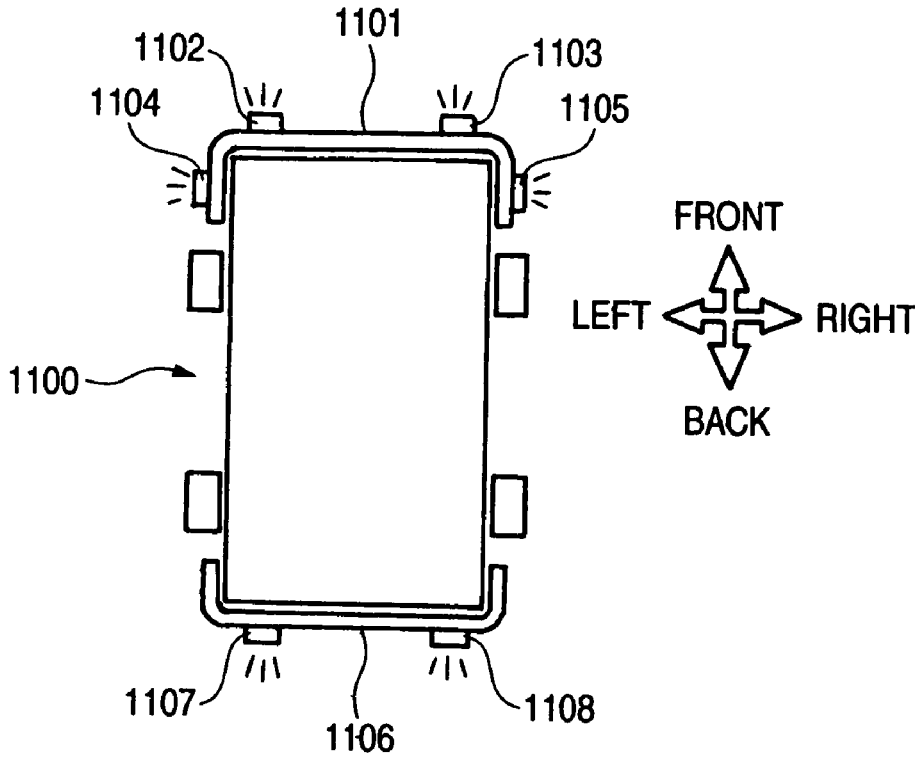
FIG. 10(A) is an outline plane view showing a state of providing left and right headlamps, left and right direction indicator lamps and left and right tail lamps to an automobile.
FIG. 10(B) is a diagram showing a circuit of a prior art for wiring electric wires to the headlamps, the direction indicator lamps and the tail lamps of the automobile.
Figure 10:
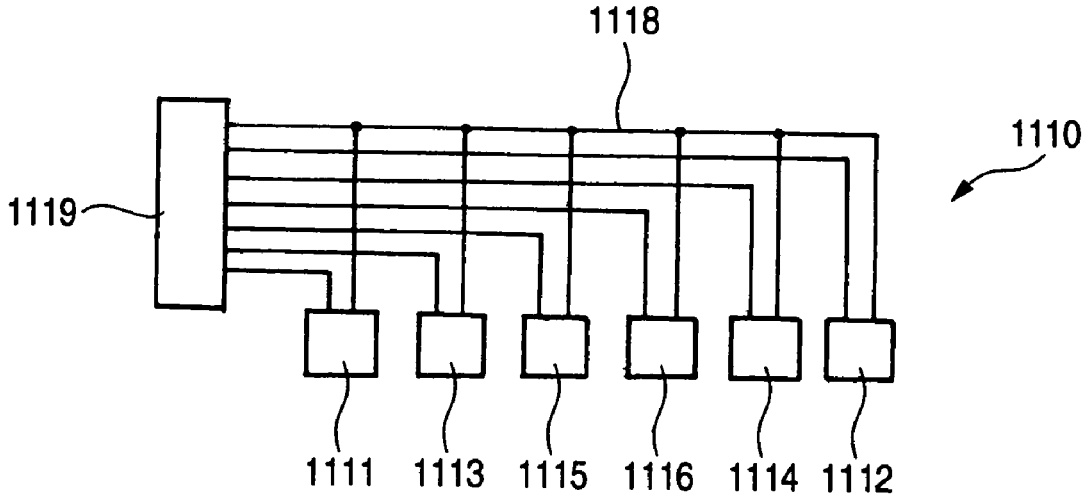
Figure 11:
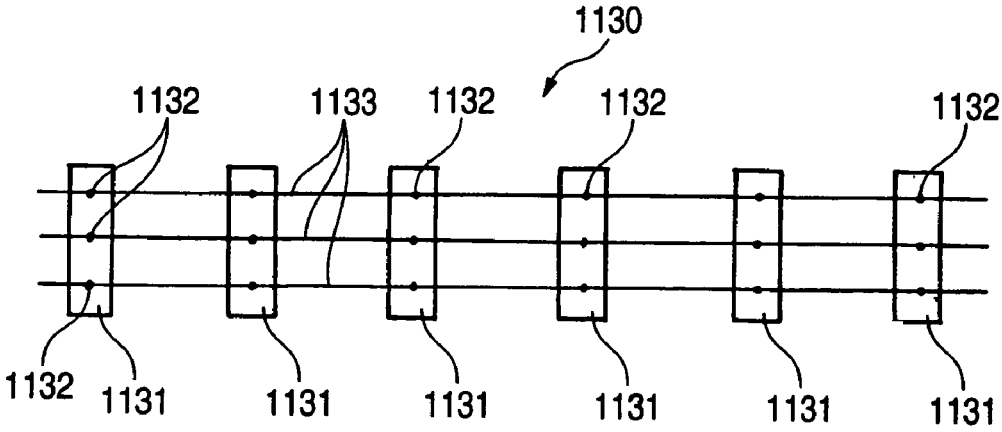
FIG. 11 is a perspective view showing a waterproof connector of a conventional art.
Figure 12:
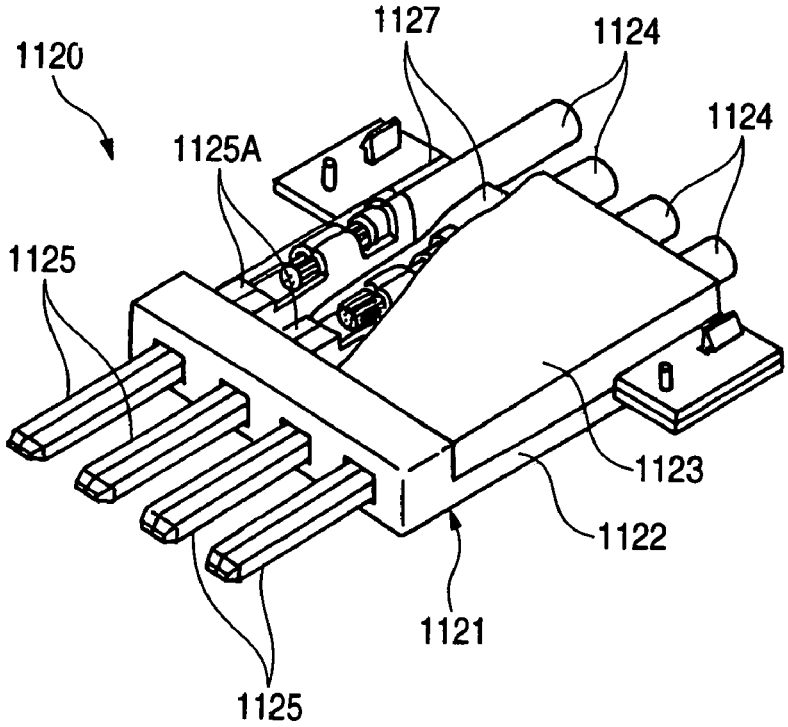
FIG. 12 is a view showing a wire harness circuit of a prior art wiring electric wires to the headlamps, the direction indicator lamps and the tail lamps of the automobile of a conventional art.

As shown by FIG. 8 through FIG. 9, the seal member filling layer 17 is provided by a wall 27 surrounding the respective press contact blades 14 and end portions 29 of the respective flat electric wires 23 can be contained between an inner side face 28 of the housing 11 and the wall 27.

By containing the end portions 29 of the respective flat electric wires 23 between the inner side face 28 and the wall 27, the end portions 29 of the respective flat electric wires 23 can firmly be immersed into the seal member 16.

As has been explained above, according to the water proof connector 10, the housing 11 is provided with the seal member filling layer 17 capable of containing the seal member 16 covering the press contact blades 14.

Thereby, by covering the respective press contact blades 14 by the seal member 16 by filling the seal member 16 into the seal member filling layer 17, the waterproof can be promoted by protecting the respective press contact blades 14 and the flat electric wires 23 against invasion of water.

In addition thereto, by covering the respective press contact blades 14 by the seal member 16 by filling the seal member 16 into the seal member filling layer 17, insulating performance of the respective press contact blades 14 and the flat electric wires 23 can be promoted and locking performance of the flat electric wires 23 can be promoted.

Further, although an explanation has been given of the example of providing the seal member filling layer 17 at the housing 11 in the above-described embodiment, the embodiment is not limited thereto but the seal member filling layer 17 can also be provided at the rear cover 15, further, the seal member filling layer 17 can also be provided at both of the housing 11 and the rear cover 15.

Further, although an explanation has been given of the example of protecting the seal member 16 by the rear cover 15 and preventing the seal member 16 from being scattered by the rear cover 15, the rear cover 15 can also be dispensed with by selecting physical properties of the seal member 16.

Second Embodiment

Figure 13:
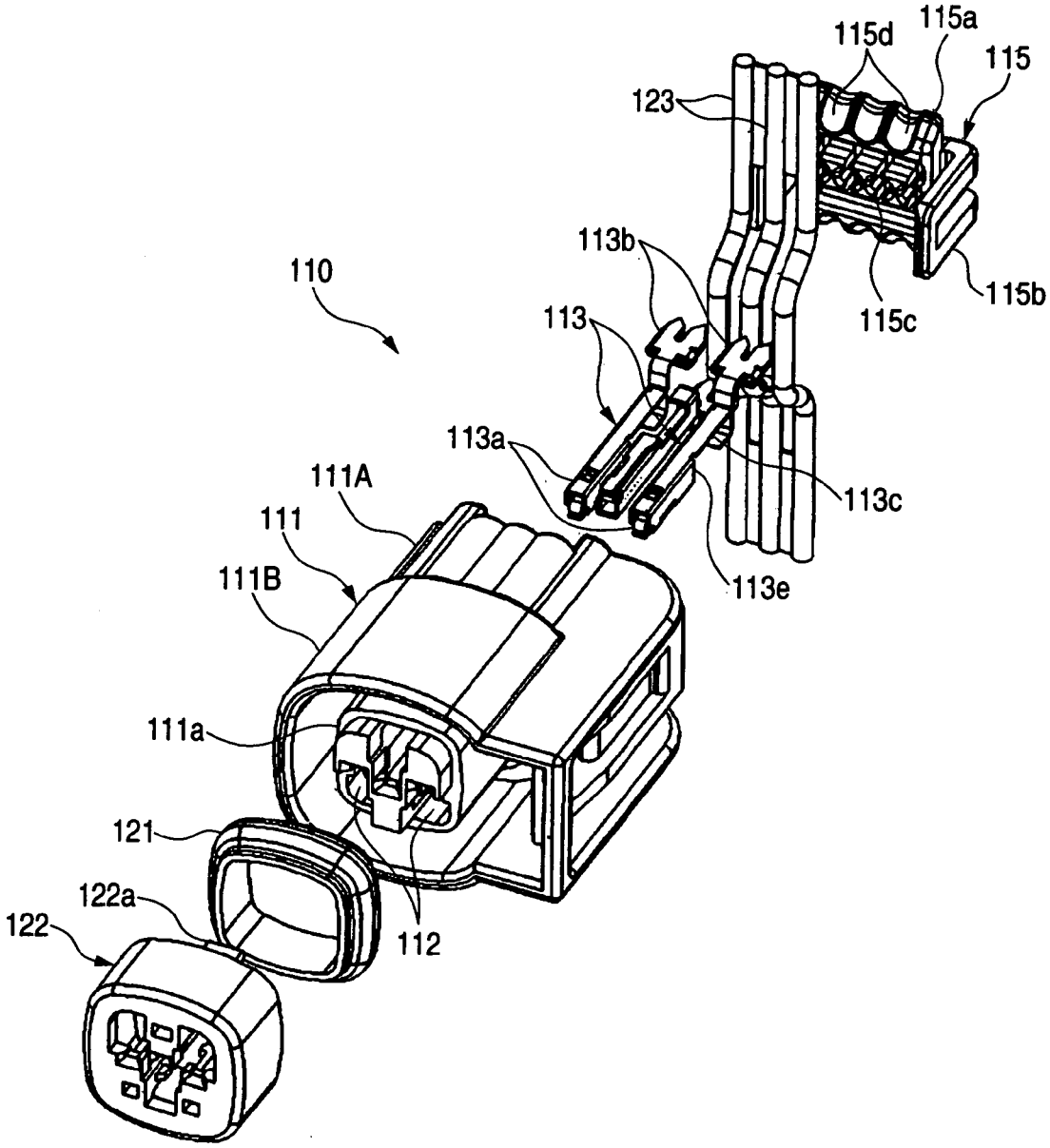
FIG. 13 is a disassembled perspective view of a waterproof connector according to a second embodiment of the present invention.
Figure 14:
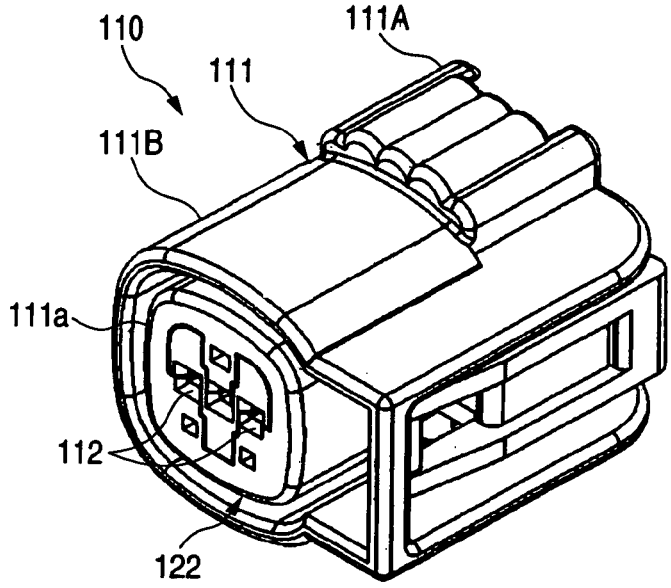
FIG. 14 is a front perspective view showing a state of integrating a packing and a front cover to a housing of the waterproof connector.
Figure 15:
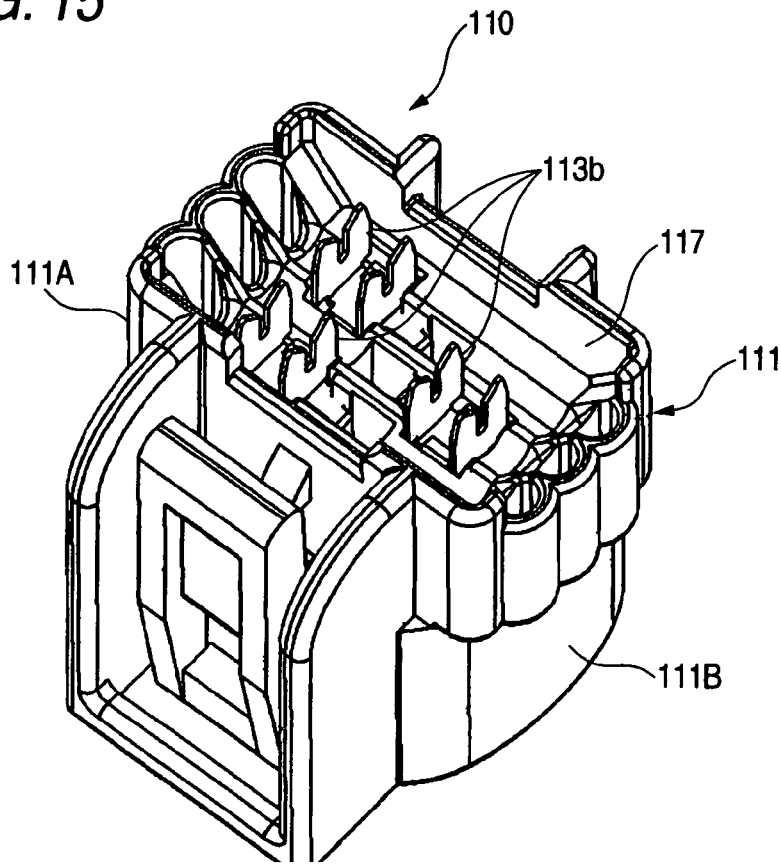
FIG. 15 is a rear perspective view showing a state of inserting a connecting terminal to the housing of the waterproof connector.

As shown by FIG. 13 through FIG. 15, a waterproof connector 110 of a second embodiment of the present invention is provided with a housing 111, a connecting terminal 113, a rear cover 115, a packing 121, and a front cover 122. The housing 111 is formed substantially in a rectangular parallelepiped by an insulating synthetic resin and is provided with a number of inserting holes 112 at inside thereof. A rear portion 111A is formed to be able to attach the rear cover 115 and a front portion 111B is formed with an inner cylinder portion 111*a*, and the inner cylinder portion is fit with the packing 121 for waterproof and is attached with the front cover 122 (refer to FIG. 19, FIG. 20). Further, as shown by FIG. 15, the rear portion 111A is formed with a seal member filling layer 117, that is, a containing recess portion capable of containing a flat electric wire 123.

As shown by FIG. 13 and FIG. 15, the connecting terminal 113 is a conductive member formed substantially in a cylindrical shape by a conductive material of a metal or the like, a connecting portion 113*c* is extended from an electric contact portion 113*a* formed at a front end and a pair of press contact blades 113*b* are formed at an end portion of the connecting portion 113*c*. Further, a locking portion 113*e* is formed at a rear end of the electric contact portion 113*a*. The connecting terminals 113 can be inserted into a number of the inserting holes 112 provided at the housing 111 and when inserted, the press contact blade 113*b* is exposed to the seal member filling layer 117 at the rear portion 11A of the housing 11. The pair of press contact blades 13*b* are formed in a bifurcated shape and are formed with a receiving recess portion for pressing the flat electric wire 123 to be brought into press contact therewith. By pressing the flat electric wire 123 to the receiving recess portion, the press contact blade 113*b* breaks a cover of the flat electric wire 123 to be brought into contact with a core wire and the press contact blades 113*b* (connecting terminal 113) and the flat electric wire 123 are electrically connected.

Figure 16:
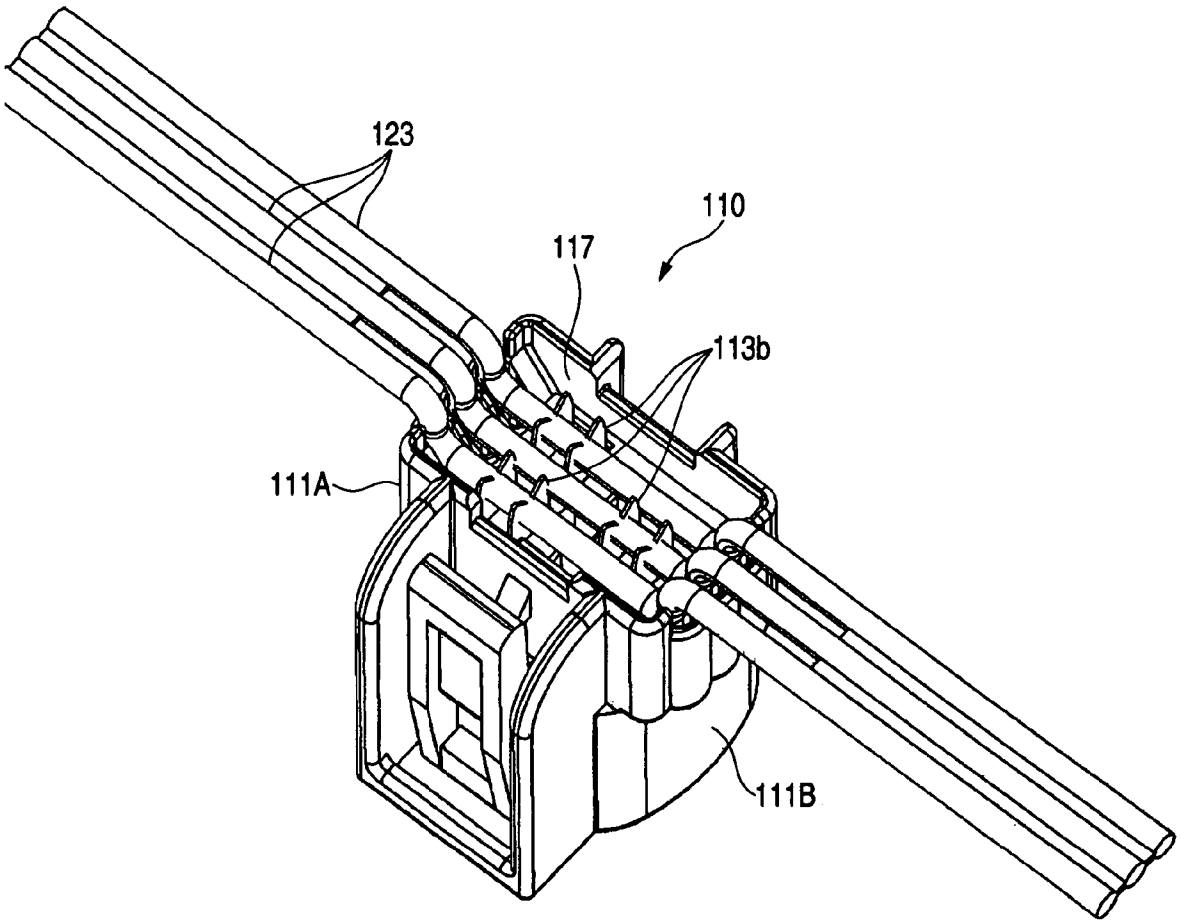
FIG. 16 is a rear perspective view showing a state of bringing a flat electric wire into press contact with a press contact blade of the connecting terminal.

As shown by FIG. 15 and FIG. 16, according to the connecting terminal 113 inserted to the inserting hole 112 of the housing 111, since the press contact blade 113*b* is disposed to direct to an opening portion of the seal member filling layer 117, a middle portion of the flat electric wire 123 can be bent substantially in a channel-like shape in line with the seal member filling layer 117 and inserted from the opening portion of the seal member filling layer 117 and pressed to the press contact blade 113*b* to thereby simply brought into press contact therewith. Thereby, the flat electric wire 123 can be attached thereto in the state of passing the waterproof connector 110, that is, the through state.

Figure 18:
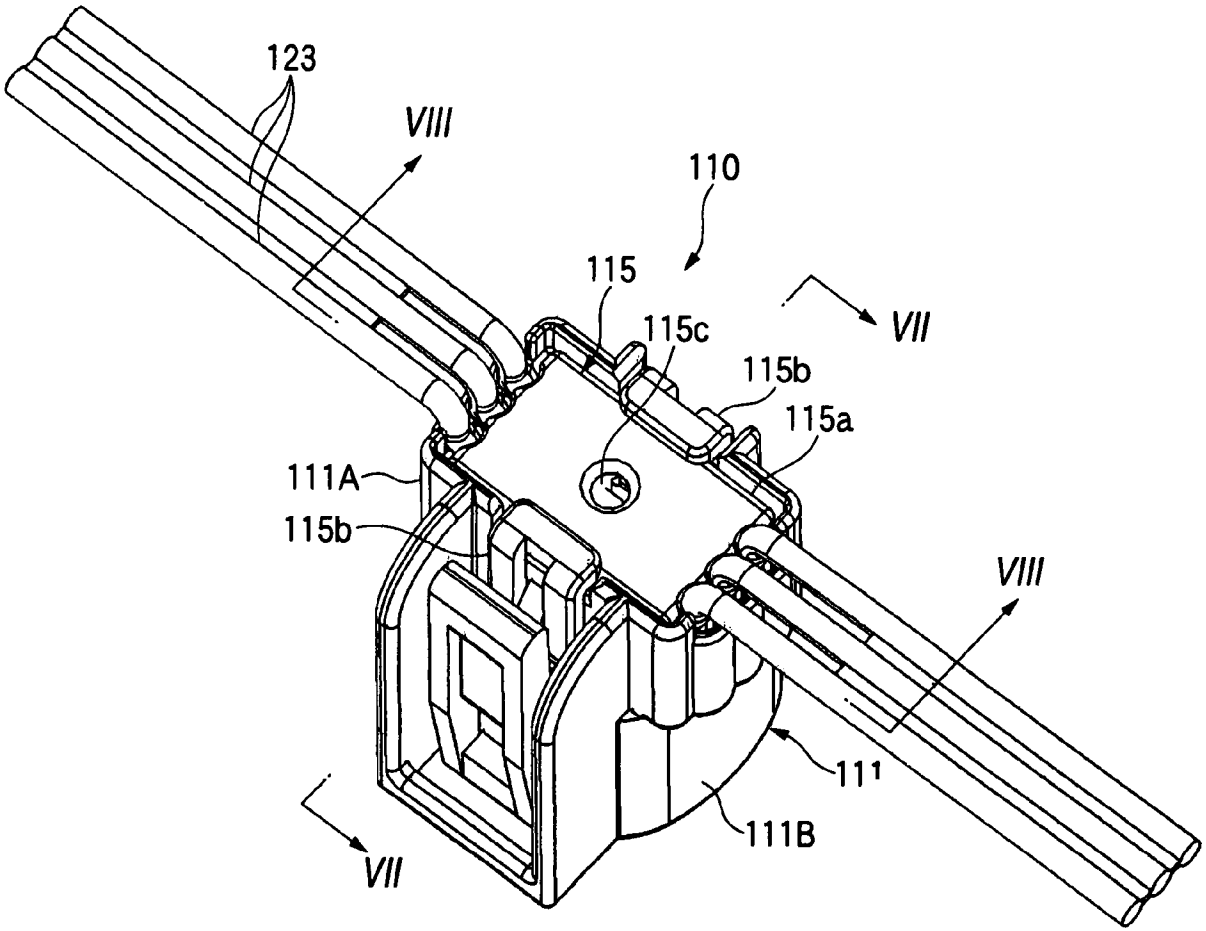
FIG. 18 is a rear perspective view showing a state of mounting a rear cover to the housing of the waterproof connector with which the flat electric wire is brought into press contact.

As shown by FIG. 13 and FIG. 18, the rear cover 115 is formed by an insulating synthetic resin and a pair of locking arms 115*b* are provided to project to the front side from both side ends of a main body 115*a* in a flat plate shape. The main body 115*a* is provided with a seal member injecting hole 115*c* and is formed with a fixing groove 115*d* substantially in a semicircular shape for containing the flat electric wire 123 and a rib 115*e* at a rear face thereof.

Figure 19:
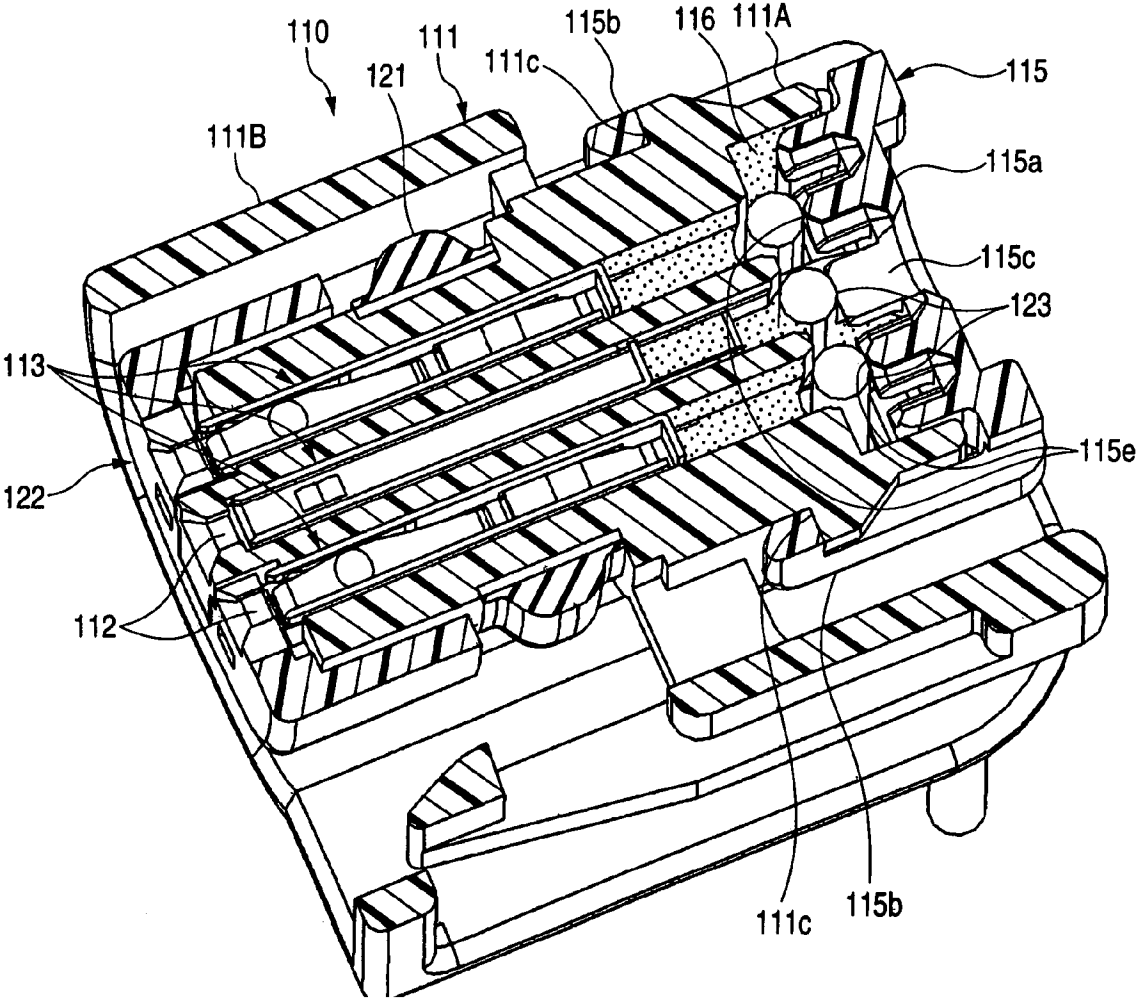
FIG. 19 is a sectional perspective view taken along a line VII—VII of FIG. 18 of the waterproof connector wired with the flat electric wire in a through state.

As shown by FIG. 18 and FIG. 19, the rear cover 115 is fixed in a state of closing the opening portion of the seal member filling layer 117 by the main body 115*a* by inserting the pair of engaging arms 115*b* from the rear portion 111*a* of the housing 111 to engage with an engaging projection 111*c* provided at the housing 111.

Figure 20:
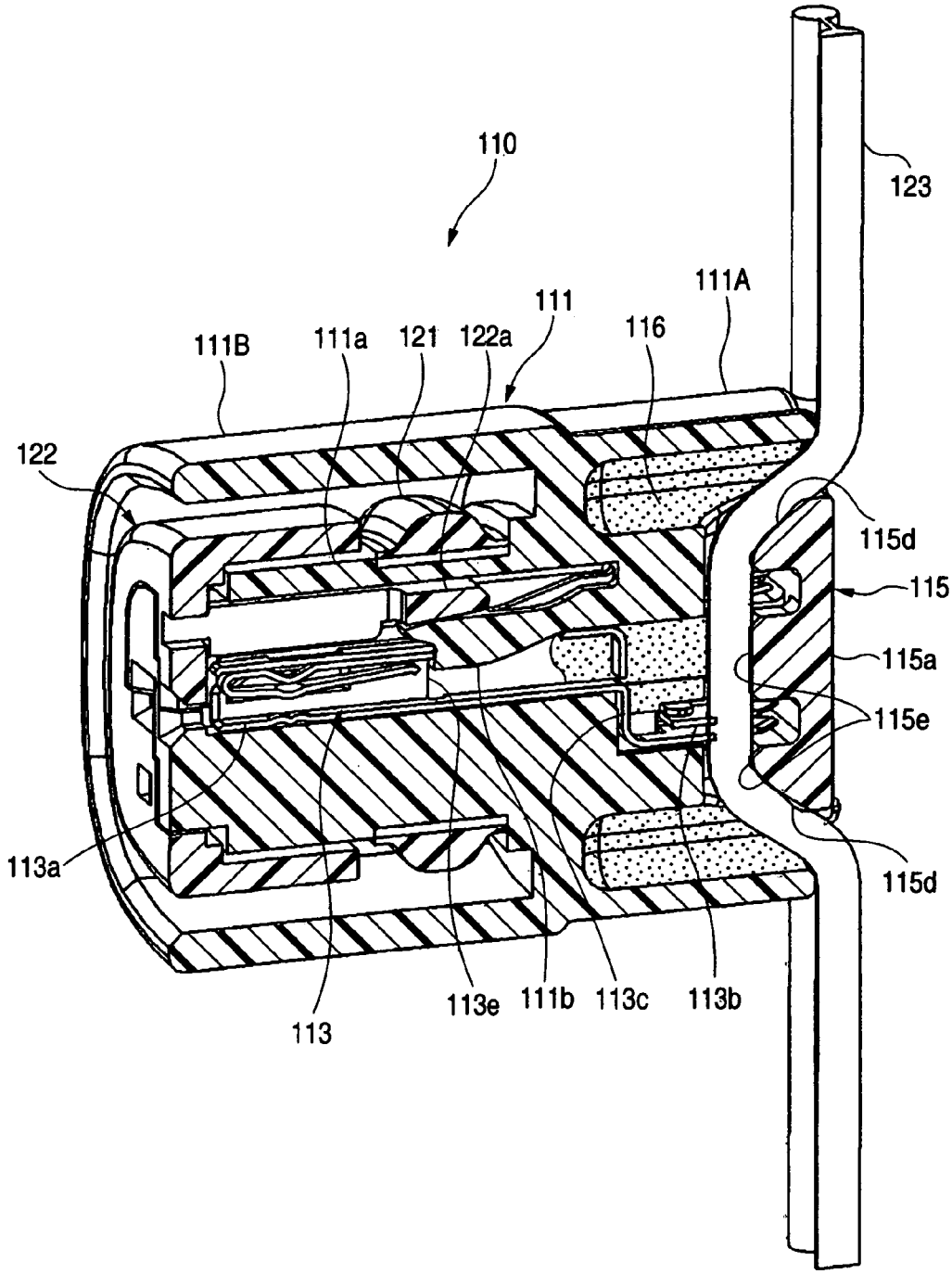
FIG. 20 is a sectional perspective view taken along a line VIII—VIII of FIG. 18 of the waterproof connector wired with the flat electric wire in the through state.

As shown by FIG. 20, the rib 115*e* of the main body 115*a* fixed to the seal member filling layer 117 is brought into contact with the flat electric wire 123 contained in the seal member filling layer 17 by being bent substantially in a channel-like shape to press to thereby prevent the flat electric wire 123 from separating from the press contact blade 113*b*.

As shown by FIG. 13, FIG. 19 and FIG. 20, the packing 121 is for waterproofing a front side (left direction in FIG. 19) of the housing 111 and is mounted to fit to the inner cylinder portion 111*a* and achieves a waterproof function by being brought into sliding contact with an inner peripheral face of a counter connector housing, not illustrated. The front cover 122 is formed by an insulating synthetic resin and is inserted from the front side of the housing 121 to fix to the housing 111 to constitute a front end portion of the inserting hole 112.

In integrating the above-described waterproof connector 110, as shown by FIG. 13, FIG. 14, FIG. 19 and FIG. 20, the connecting terminal 113 is inserted into the inserting hole 112 from the rear side of the housing 111 and a locking portion 113*e* provided at the connecting terminal 113 is engaged with a lance 111*b* formed at the housing 111. At this occasion, as shown by FIG. 15, the press contact blade 123*b* is brought into a state of being exposed to the seal member filling layer 117.

Successively, the packing 121 is fit to the inner cylinder portion 111*a* of the housing 111 and thereafter, the front cover 122 is inserted from the front portion 111*b* of the housing 111 to attach. At this occasion, a locking projection 122*a* formed at the front cover 122 invades an interval between the lance 111*b* and an inner peripheral face of the inner cylinder portion 111*a* to thereby prevent the lance 111*b* from being bent in a direction of releasing locking of the connecting terminal 113 to double-lock. (Refer to FIG. 20).

As shown by FIG. 16 and FIG. 20, the middle portion of the flat electric wire 123 is bent substantially in the channel-like shape in line with the seal member filling layer 117 and inserted from the opening portion of the seal member filling layer 117 and pressed to the press contact blade 113*b* to be brought into press contact therewith to thereby attach the flat electric wire 113 to the connecting terminal 113 in the through state. Further, as shown by FIG. 18 and FIG. 19, the rear cover 115 is inserted from the rear portion 1111A of the housing 111 and the pair of locking arms 15*b* are engaged with the engaging projections 111*c*. Thereby, the main body 115*a* is fixed in the state of closing the opening portion of the seal member filling layer 117.

At this occasion, the rib 15*e* is brought into contact with the flat electric wire 123 arranged at inside of the seal member filling layer 117. Thereby, even when an external force is operated to the flat electric wire 123, the flat electric wire 123 is not separated from the press contact blade 113*b* and a state of bringing the flat electric wire 123 into press contact with the press contact terminal 113 is maintained before filling a seal member. Therefore, in operation of filling a seal member 116, mentioned later, handling of the waterproof connector 110 attached with the rear cover 115 is facilitated. Further, after filling the seal member 116, even when the seal member 116 is not cured, operation of a successive step or the like can be carried out.

Figure 17:
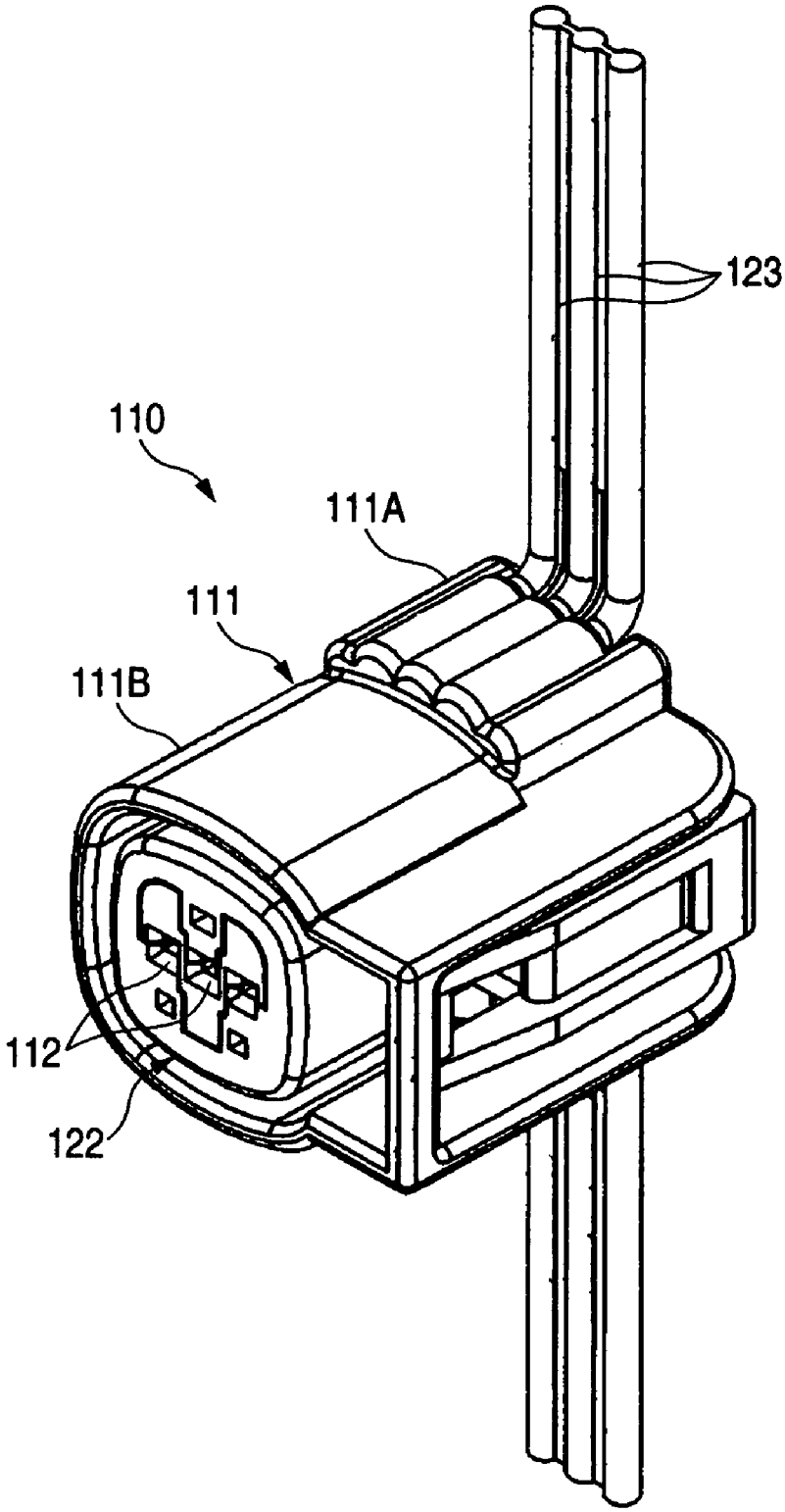
FIG. 17 is a front perspective view showing the waterproof connector in a state of finishing integration by wiring the flat electric wire.

Further, as shown by FIG. 19 and FIG. 20, the seal member 116 is filled from the seal member injecting hole 115*c* of the rear cover 115 into the seal member filling layer 117 to fill a clearance at inside of the seal member filling layer 117 with the seal member 116 and the flat electric wire 123 is immersed in the seal member 116 along with the press contact portion. FIG. 17 shows a state in which the flat electric wire 123 is wired in the through state and integration of the waterproof connector 110 filled with the seal member 16 is finished.

In filling the seal member 116, the seal member 116 is filled from the seal member injecting hole 116*c* of the rear cover 115 closing the opening portion of the seal member filling layer 117 and therefore, the seal member is not leaked or extruded and the seal member 116 can be prevented from being scattered to adhere to a surrounding. Further, a position of filling the seal member 116 is clear and an amount of filling the seal member 116 is prescribed by a volume of the seal member filling layer 117 and therefore, a state of filling the seal member 116 is not dispersed by an operator. Therefore, dispersion of the waterproof function is prevented and the stable waterproof function can be ensured.

Here, as the seal member 116, ultraviolet ray cured rubber, RTV silicone rubber (one solution, two solution type), foamed urethane, hot melt or the like can be used. Foamed urethane is foamed when two solutions are mixed therewith to expand the volume by multiplication of twice through thrice therefore, when foamed urethane is filled in the seal member filling layer 117 the opening portion of which is closed by the rear cover 115, foamed urethane can be filled to corners in the seal member filling layer 117 and excellent in the waterproof function and can preferably be used.

Figure 21:
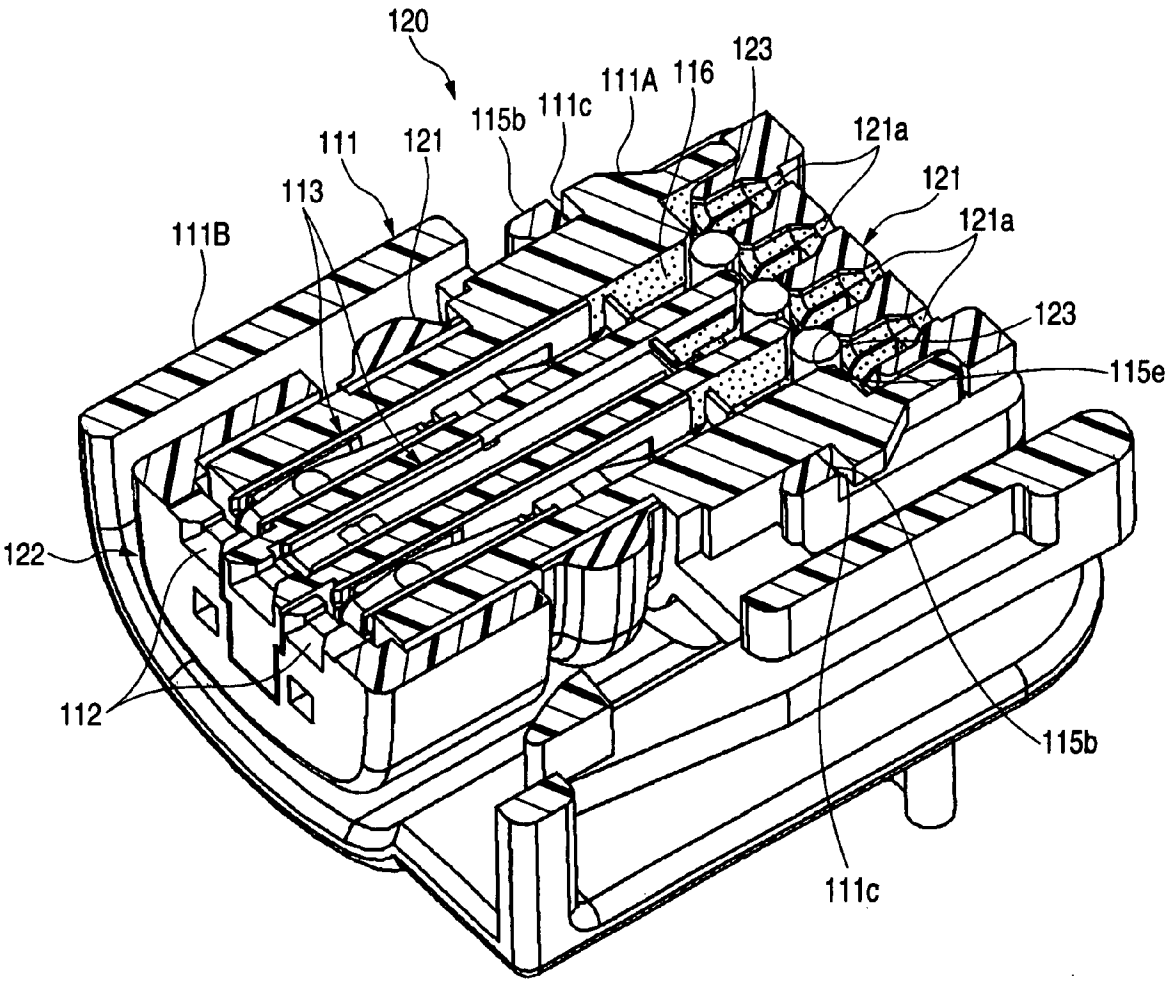
FIG. 21 is a sectional perspective view showing a state of integrating a waterproof connector of a modified example of the second embodiment of the invention.

Next, an explanation will be given of a modified example of the waterproof connector in reference to FIG. 21. FIG. 21 is a sectional perspective view showing a state of integrating a waterproof connector of the modified example. As shown by FIG. 21, a waterproof connector1 20 of the modified example differs from the waterproof connector 110 of the first embodiment in a rear cover 121 thereof. Specifically, the rear cover 121 is provided with seal member injecting holes 121*a* at four locations by reducing a hole diameter thereof.

Since the seal member injecting hole 121*a* is small, the seal member 116 before being cured is difficult to flow out from the seal member filling layer 117 and the seal member 116 having a comparatively low viscosity can be used. Therefore, the seal member 116 can firmly be filled also to the seal member filling layer 117 having a complicated shape. Further, since the seal member injecting holes 121*a* are provided to disperse, even when the seal member filling layer 117 is formed in a shape difficult to fill the seal member 116, the seal member 116 can easily be filled thereto by injecting the seal member 116 from a plurality of locations.

The other portion is similar to that of the waterproof connector 110 of the first embodiment of the invention and therefore, the same portions are attached with the same notations or corresponding notations and an explanation thereof will be simplified or omitted.

Third Embodiment

Next, an explanation will be given of a third embodiment of a waterproof connector of the invention in reference to FIG. 22 through FIG. 25.

Figure 22:
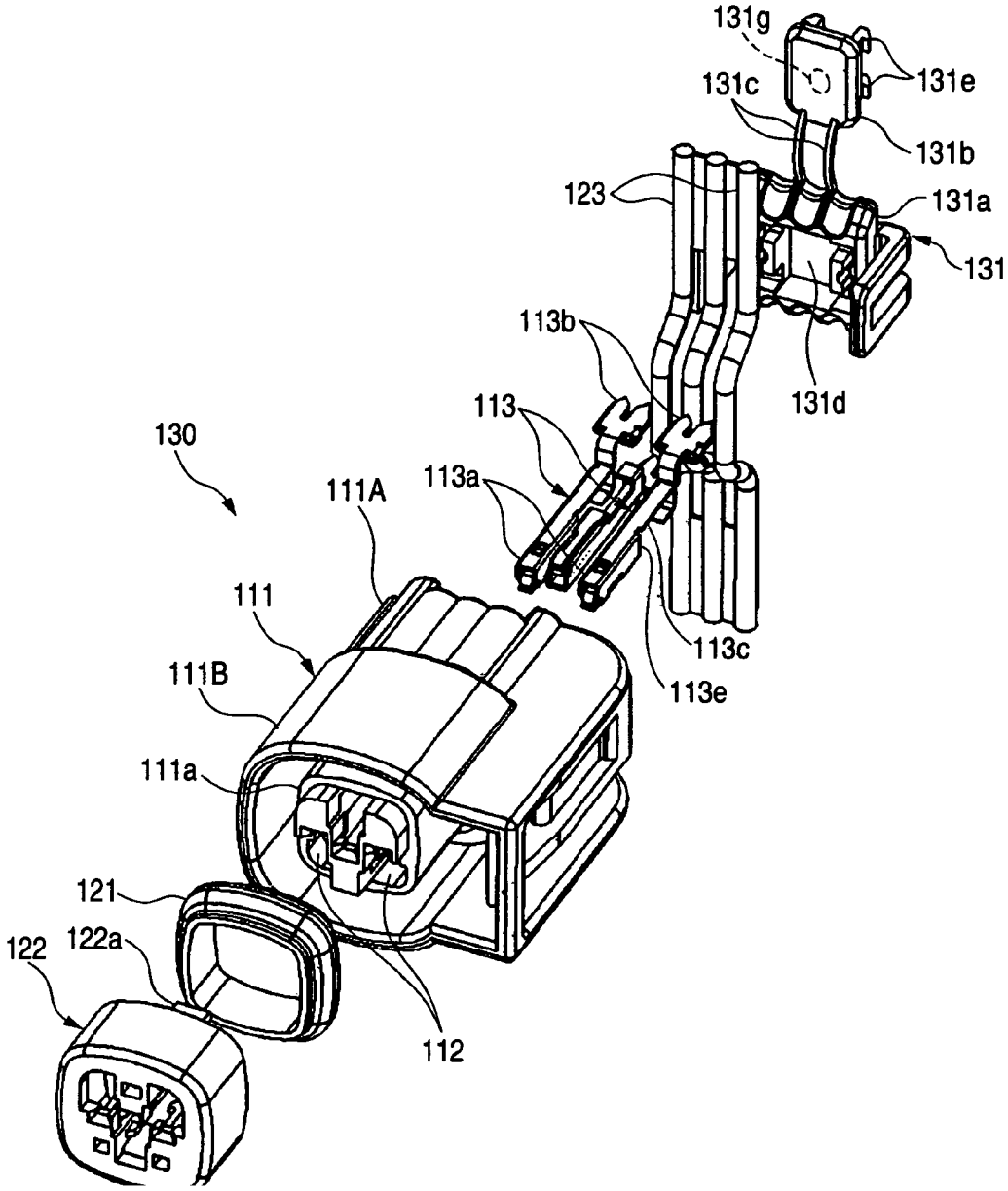
FIG. 22 is a disassembled perspective view of a waterproof connector according to a third embodiment of the invention.
Figure 23:
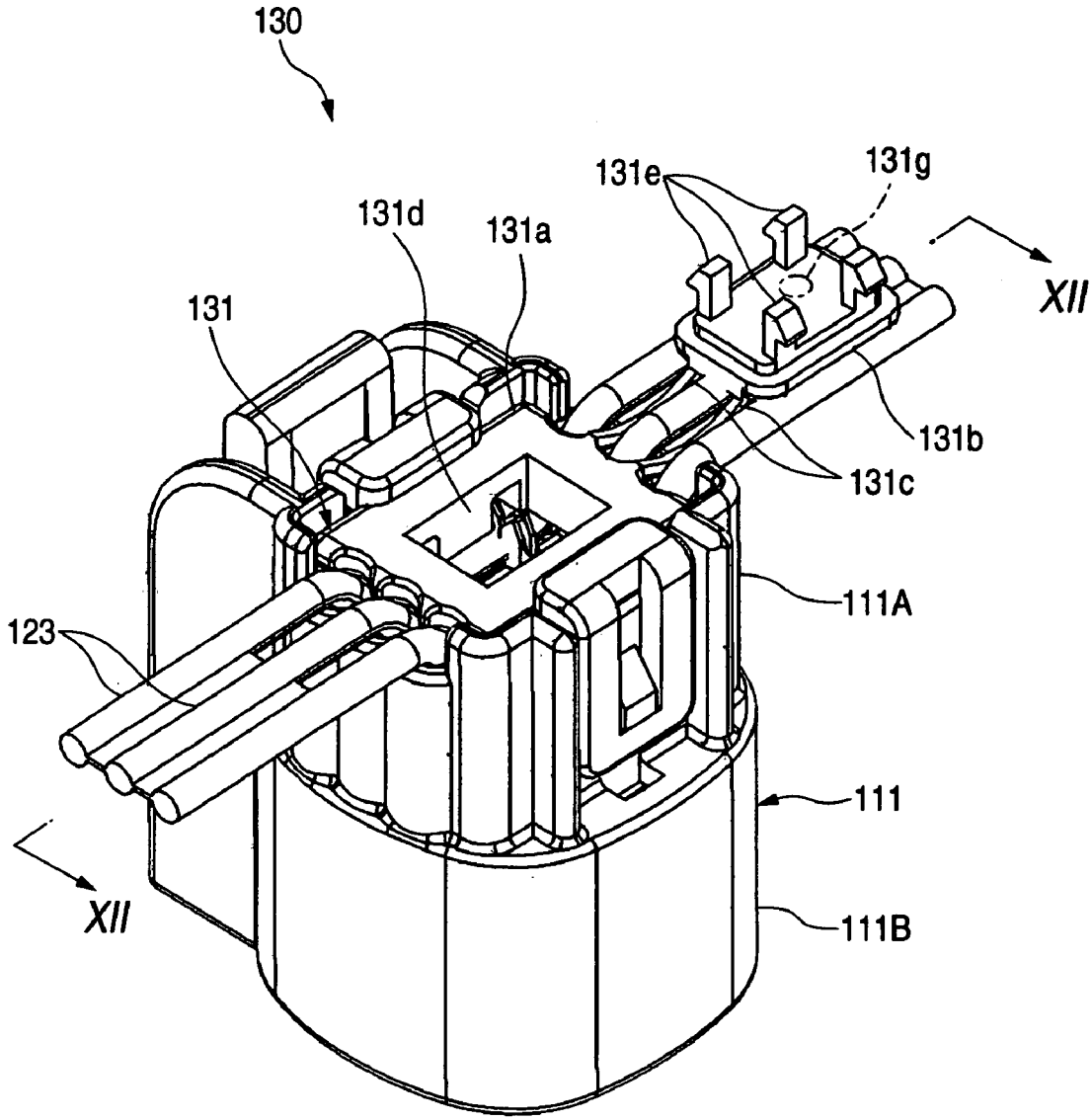
FIG. 23 is a rear perspective view showing a state of mounting a rear cover to the housing of the waterproof connector with which the flat electric wire is brought into press contact.

As shown by FIG. 22 and FIG. 23, a waterproof connector 130 of the third embodiment differs from the waterproof connector 110 of the second embodiment in a rear cover 131 thereof. Specifically, the rear cover 131 is constituted by a main body portion 131*a* and a lid member 131*b* and the main body portion 131*a* and the lid member 131*b* are connected by two pieces of connecting portions 131*c* formed in a string-like shape and having an elasticity. The main body portion 131*a* is bored with a large square hole 131*d*. Further, the lid member 131*b* is a member in a flat plate shape having an area larger than that of the square hole 131*d* and is formed with four piece of locking arms 131*e* to project.

Figure 24:
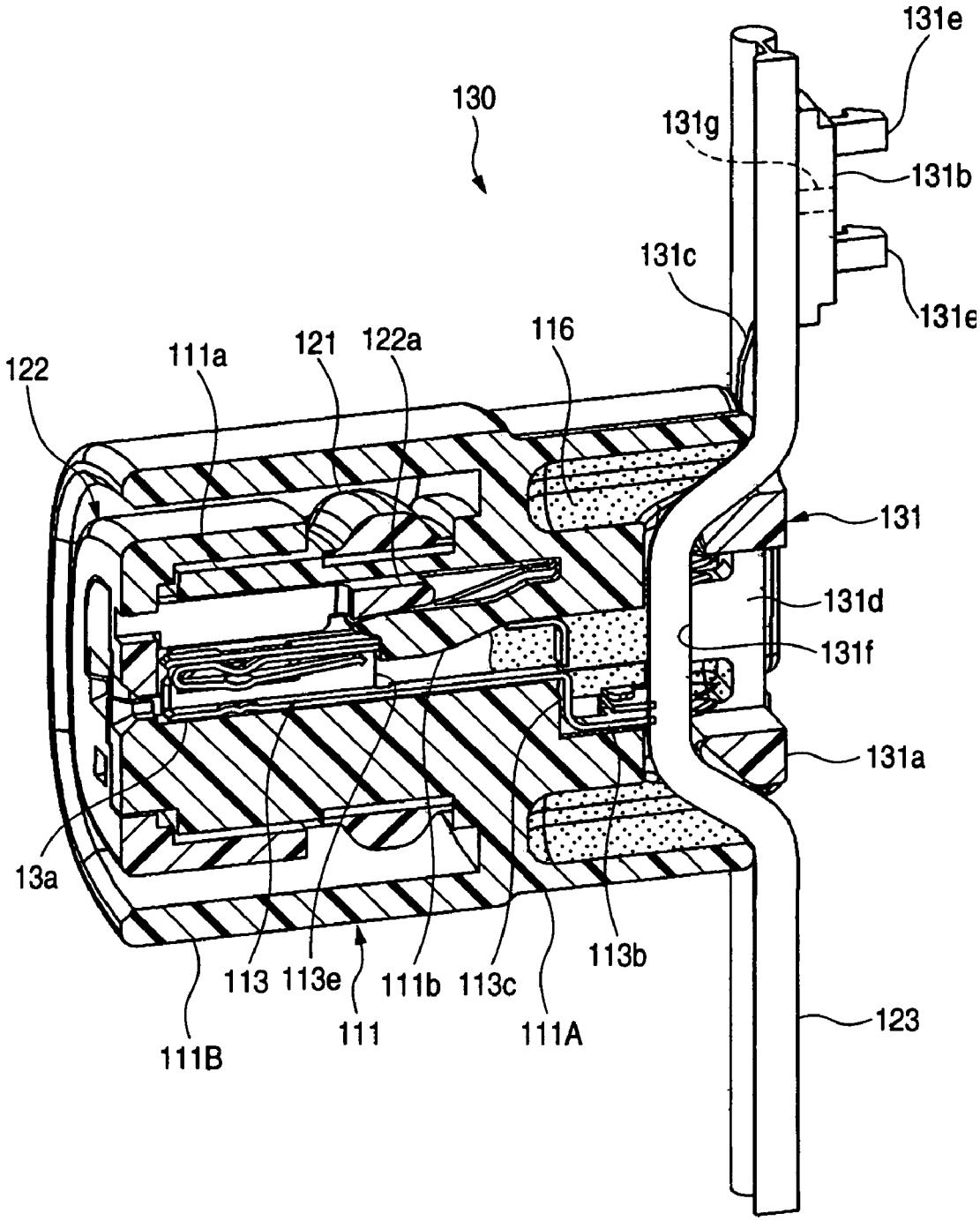
FIG. 24 is a sectional perspective view taken along a line XII—XII of FIG. 23 of the waterproof connector wired with the flat electric wire in the through state.

As shown by FIG. 24, the rear cover 1131 is inserted from the rear portion 11A of the housing 111 in which the flat electric wire 123 is brought into press contact with the press contact blade 113*b* of the connecting terminal 113 and integrated into the seal member filling layer 117 and similar to the waterproof connector 110 of the second embodiment, a pair of locking arms (not illustrated) are engaged with engaging projections (not illustrated) of the housing 111. At this occasion, a rib 131*f* is brought into contact with the flat electric wire 123 arranged at inside of the seal member filling layer 117 to thereby protect a state of bringing the flat electric wire 113 into contact with the connecting terminal 113 before filling the seal member. Therefore, in operation of filling the seal member 116, mentioned later, handling of the waterproof connector 130 attached with the rear cover 131 is facilitated.

The other portion is similar to that of the waterproof connector 110 according to the embodiment of the invention and therefore, the same portions attached with the same notations or corresponding notations and an explanation thereof will be simplified or omitted.

Figure 25:
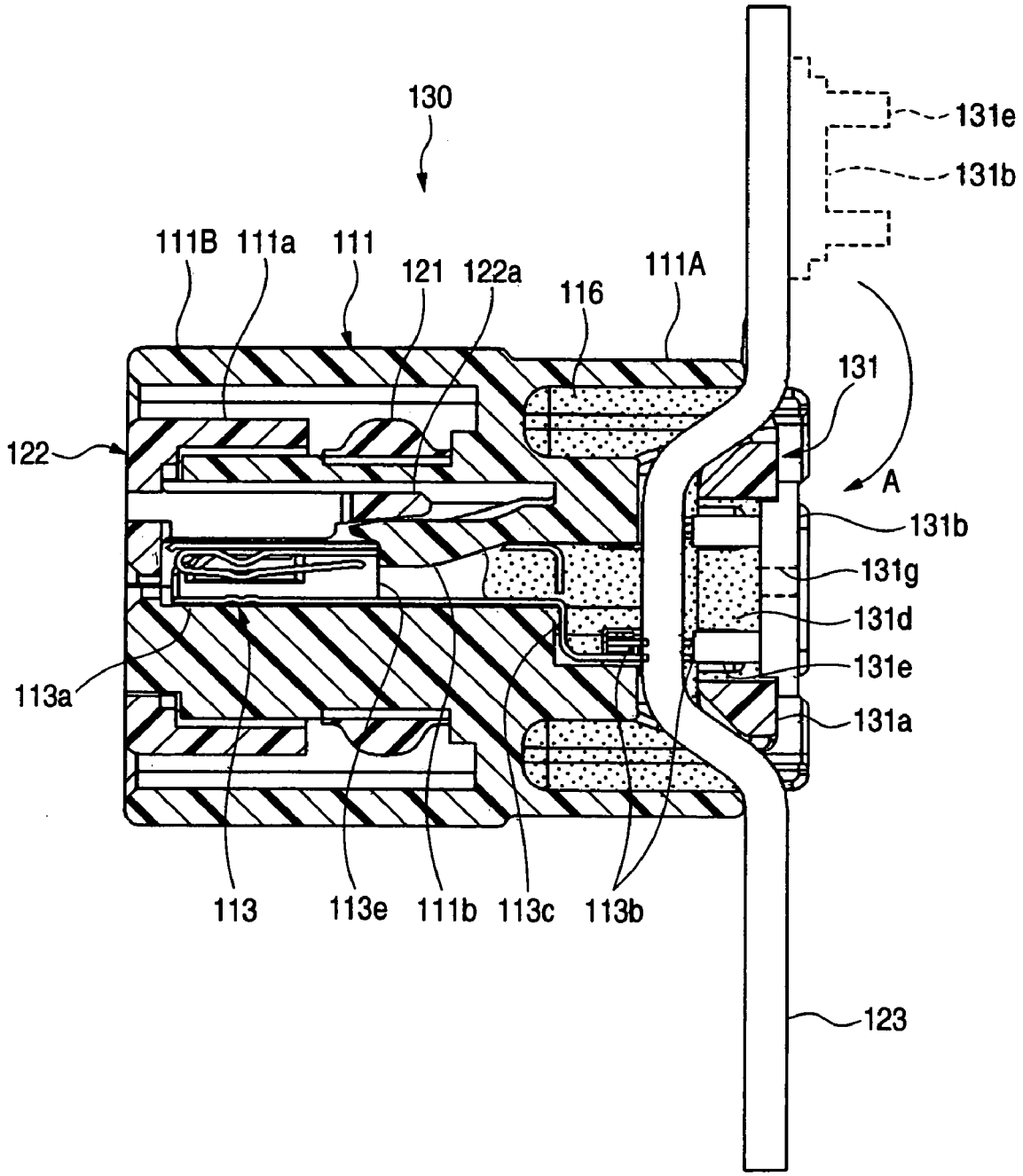
FIG. 25 is a vertical sectional view of the waterproof connector showing a state of closing an opening hole by a lid member.

The seal member 116 is filled to the seal member filling layer 117 from the square hole 131*d* and prior to filling the seal member 116, a situation of inside of the seal member filling layer 117 (for example, a state of wiring the flat electric wire 1123, a state of bringing the flat electric wire 23 into press contact with the connecting terminal 113 or the like) can be confirmed by optically observing from the square hole 131*d* and further highly reliable integration can be carried out. Further, as shown by FIG. 25, after filling the seal member 116 from the square hole 131*d*, the connecting portion 131*c* is bent in a U-like shape to thereby move from a position designated by a broken line of the drawing to a position designated by a bold line in an arrow mark A direction and the seal member 116 is prevented from flowing out from the seal member filling layer 117 by closing the square hole 131*d* by the lid member 131*b*. Further, after curing the seal member 116, the lid member 131*b* and the main body portion 131*a* are integrally adhered to each other by the seal member 116.

Further, as a modified example of the waterproof connector according to the third embodiment, the lid member 131*b* of the rear cover 131 shown in the waterproof connector 130 of the third embodiment may be formed with a seal member injecting hole 131*g* shown by a broken line in FIG. 22 through FIG. 25. In this case, in filling the seal member 116 to the seal member filling layer 117, after covering the lid member 131*b* to close the square hole 131*d* formed at the main body portion 131*a* of the rear cover 131, the seal member 116 is injected from the seal member injecting hole 131*g* to fill the seal member filling layer 117 with the seal member 116. According to the modified example, prior to filling the seal member 116, a state in the seal member filling layer 117 can be confirmed from the square hole 131*d* by opening the lid member 31*b*. Further, the seal member 16 is filled from the seal member injecting hole 131*d* smaller than the square hole 31*d* and therefore, the seal member 116 can firmly be prevented from being extruded. Further, the seal having a low viscosity can be used.

Figure 26:
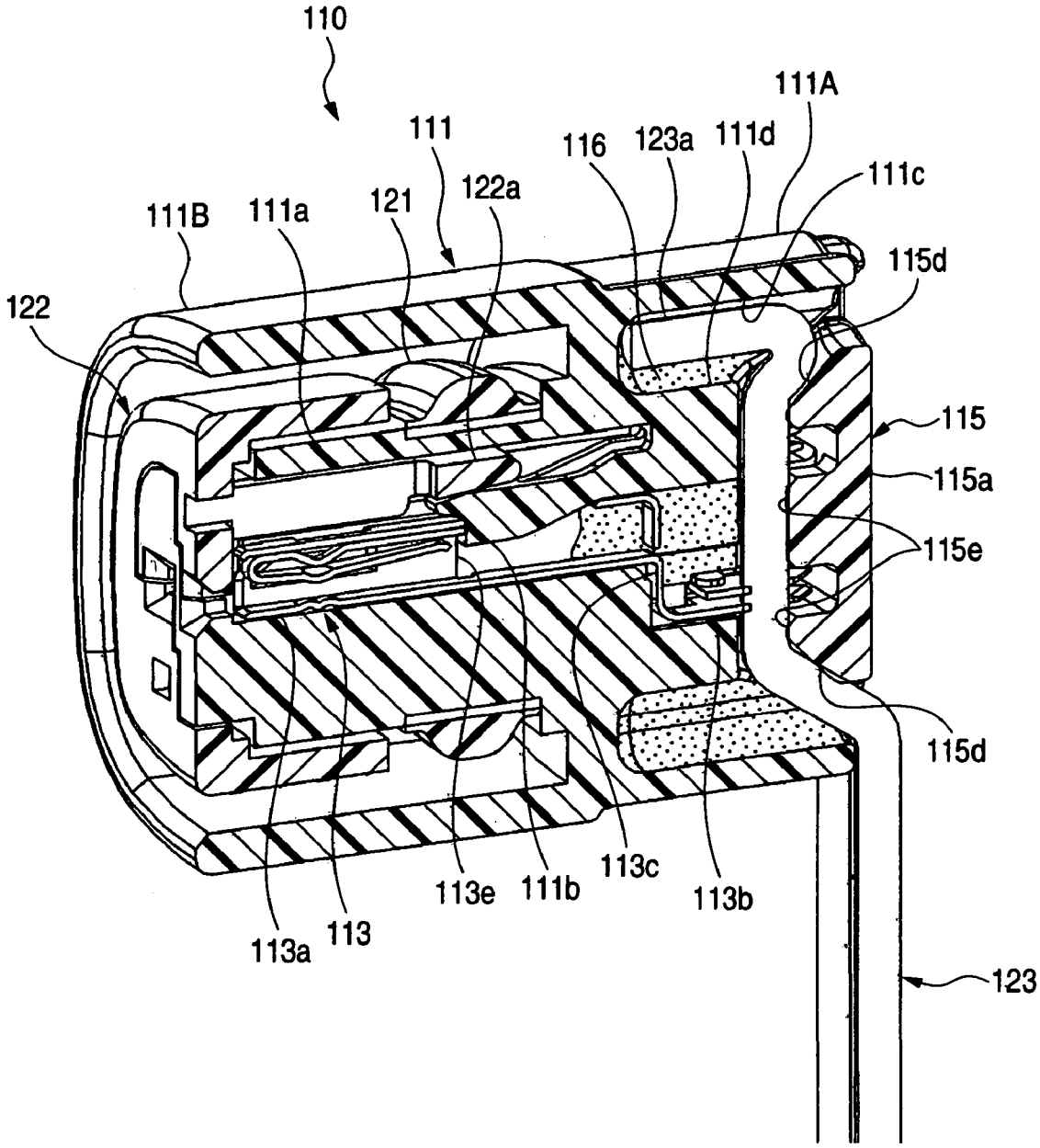
FIG. 26 is a sectional perspective view showing an example of containing an end portion of the flat electric wire in the waterproof connector according to the invention.

Further, as shown by FIG. 26, the waterproof connectors 110, 120, 130 of the invention can not only bring the middle portion of the flat electric wire 123 into press contact with the connecting terminal 113 to connect in the through state but also connect an end portion 23*a* of the electric wire 123. That is, by containing the end portion 123*a* of the electric wire 123 between the inner side face 111*c* of the housing 111 and a wall 111*d* surrounding the press contact blade 113*b* and filling the seal member 116, the end portion 123*a* of the electric wire 123 can firmly be subjected to the waterproof treatment.

Furthers the waterproof connector of the invention is not limited to the above-described constitution of the embodiment but can naturally adopt various modes based on the gist of the invention.

For example, although an explanation has been given of the example of using the flat electric wire 23 as the electric wire to be brought into press contact therewith in the above-described embodiment, a plurality of covered electric wires can be used by being aligned in parallel.

Further, the invention is not limited to the above-described embodiments and modified examples but can pertinently be modified or improved. Otherwise, a material, a shape, a dimension, a numerical value, a mode, a number, an arranging location of each constituent element of the above-described embodiments and modified examples are arbitrary so far as these can achieve the invention and are not limited.

Although according to the invention, an explanation has been given such that the seal member filling layer is provided at the housing, the invention is not limited thereto but the seal member filling layer can also be provided at the rear cover, further, can be provided to both of the housing and the rear cover. Further, the invention can also be used as a waterproof structure of a connector of a kit cut structure constituting the connector by cutting an inner housing formed in parallel with a plurality of section chambers for containing a connecting terminal by a unit of a desired number of section chambers to insert into an outer housing.

As has been explained above, according to the waterproof connector of the present invention, the seal member filling layer capable of containing the seal member for covering the respective press contact blades is provided at at least one of the housing and the rear cover.

Thereby, waterproof can be promoted by protecting the respective press contact blades against invasion of water by covering the respective press contact blades by the seal member by filling the seal member to the seal member filling layer.

In addition thereto, insulating performance of the respective press contact blades can be promoted and locking performance of the respective press contact blades can be promoted by covering the respective contact blades by the seal member by filling the seal member into the seal member filling layer.

Further, according to the waterproof connector of the present invention, by making the planer shape of the seal member filling layer larger than the shape of the opening of the inserting hole, the stepped difference portion is formed at the boundary between the seal member filling layer and the inserting hole.

Therefore, when the seal member is filled only to the seal member filling layer, in the case of exerting a drawing force to the respective press contact blades, there is a concern of stripping the seal member off the stepped difference portion. Hence, the seal member is prevented from being stripped off the stepped difference portion by filling the seal member up to the inserting hole.

Thereby, waterproof, insulating performance and locking performance of the respective press contact blades can further be promoted.

Further, according to the waterproof connector of the present invention, the respective press contact blades and the respective electric wires can firmly be immersed into the seal member by bringing the respective electric wires into press contact with the respective press contact blades in the seal member filling layer to connect and bending the respective electric wires.

Thereby, waterproof, insulating performance and locking performance of the respective press contact blades and the respective electric wires can further be promoted.

Further, according to the waterproof connector of the present invention, the end portions of the respective electric wires can firmly be immersed into the seal member by containing the end portions of the respective electric wires between the inner side face of the housing and the wall.

Thereby, waterproof, insulating performance and locking performance of the end portions of the respective electric wires can further be promoted.

Further, according to the waterproof connector of the present invention, the respective press contact blades can be directed to the opening of the seal member filling layer by opening the respective press contact blades to the rear cover. Therefore, the middle portion of the electric wires can simply be brought into press contact with the press contact blades from the opening of the seal member filling layer without taking time and labor.

In this way, the waterproof connector can be connected to the middle portions of the respective electric wires and the respective electric wires can be attached thereto in a state of passing the respective electric wires through the waterproof connector, that is, in a through state.

Thereby, operability of integrating the electric wires to the waterproof connector can be promoted.

As has been explained above, according to the waterproof connector of the present invention, the housing provided with the inserting hole for inserting the connecting terminal formed with the press contact blade is formed with the seal member filling layer capable of containing the seal member for covering the press contact blade, the rear cover formed with the seal member injecting hole is mounted to the housing, the opening portion of the seal member filling layer is closed and therefore, the electric wire can be wired in the through state by pressing the electric wire to the press contact blade of the connecting terminal arranged at inside of the seal member filling layer to be brought into press contact therewith. Further, after closing the opening portion of the seal member filling layer by the rear cover, the seal member can be filled from the seal member injecting hole into the seal member filling layer. Thereby, the press contact blade wired with the electric wire in the through state is covered to subject to a waterproof treatment and the press contact blade and the press contact portion can firmly be protected. Further, reliability of a state of bringing the electric wire into press contact with the connecting terminal (press contact blade) can be promoted.

Further, control of an amount of filling the seal member is facilitated, the seal member can be prevented from being leaked or excluded from the seal member filling layer and stable waterproof function can be achieved by eliminating a dispersion in the waterproof function. Further, after curing the seal member, the rear cover is bonded to the seal member and is difficult to be stripped off and therefore, reliability of press contact is promoted by protecting the portion of bringing the electric wire into press contact with the connecting terminal (press contact blade) and the press contact portion can firmly be sealed.

Further, since the opening portion of the seal member filling layer is arranged with the rear cover to close the opening portion and therefore, the rear cover protects the seal member filled in the seal member filling layer and the seal member can be protected from being scattered. Thereby, even before the seal member is completely cured, the seal member can be transported to a successive step to carry out operation and an operational efficiency can be promoted.

Further, the rear cover is mounted to the housing immediately after bringing the electric wire into press contact with the connecting terminal (press contact blade) and therefore, even when a force is operated to the electric wire from outside before filling the seal member, the press contact portion can be protected and highly reliable wiring can be carried out.

Further, according to the waterproof connector of the present invention, the rear cover mounted to the opening portion of the seal member filling layer is constituted by the main body portion formed with the opening hole and the lid member fitted to the opening portion for closing the opening hole, the seal member is made to be able to fill from the opening hole to the seal member filling layer and therefore, after bringing the electric wire into press contact with the press contact blade of the connecting terminal, the main body portion of the rear cover is immediately mounted to the housing to fix the electric wire and the press contact portion can be protected against a force from outside. Further, after optically observing a state in the seal member filling layer (press contact state of the electric wire or the like) from the opening hole of the rear cover to confirm to be normal, the seal member can be filled from the opening hole and highly reliable operation can be carried out. Further, after filling the seal member, the opening hole is closed by the lid member and therefore, an effect similar to that described above can be achieved.

Further, according to the waterproof connector of the present invention, the rear cover is constituted by the main body portion and the lid member, the lid member is provided with the seal member injecting hole for filling the seal member and therefore, the seal member can be filled from the seal member injecting hole provided at the lid member into the seal member filling layer by mounting the rear cover to the housing in which the electric wire is brought into press contact with the connecting terminal and closing the opening hole of the rear cover by the lid member. Thereby, the seal member can be filled to an entire region of the seal member filling layer by filling the seal member into the closed seal member filling layer and waterproof can firmly be carried out.

According to the waterproof connector of the present invention, the seal member is constituted by foamed urethane and therefore, the waterproof function can be promoted by firmly filling foamed urethane to the entire region of the seal member filling layer by filling formed urethane into the seal member filling layer the opening portion of which is closed by the rear cover to foam.

What is claimed is:

1. A waterproof connector comprising:

a housing provided with a plurality of inserting holes;

a plurality of connecting terminals respectively inserted into the inserting holes, each connecting terminal having a press contact blade provided at one end portion thereof and an electric contact portion provided at the other end thereof;

a rear cover attached to the housing to cover the respective press contact blades; and a seal member filling layer provided at at least one of the housing and the rear cover;

wherein the seal member filling layer is capable of filling a seal member for covering the respective press contact blades, wherein the rear cover is mounted to the housing to close an opening portion of the seal member filling layer, and wherein the rear cover is provided with a seal member injecting hole for filling the seal member to the seal member filling layer.

2. The waterproof connector as claimed in claim 1, wherein the seal member filling layer is provided continuously to the inserting hole.

3. The waterproof connector according to claim 1, wherein the seal member filling layer is provided on a front side of a rear end of the housing, and respective electric wires can be bent by bringing the respective electric wires into press contact with the respective press contact blades to connect in the seal member filling layer.

4. The waterproof connector according to claim 1, wherein the respective press contact blades are oriented to open to the rear cover.

5. A waterproof connector comprising:

a housing provided with a plurality of inserting holes;

a plurality of connecting terminals respectively inserted into the inserting holes, each connecting terminal having a press contact blade provided at one end portion thereof and an electric contact portion provided at the other end thereof;

a rear cover attached to the housing to cover the respective press contact blades; and a seal member filling layer provided at at least one of the housing and the rear cover;

wherein the seal member filling layer is defined by a wall surrounding the respective press contact blades, and end portions of the respective electric wires can be contained between an inner side face of the housing and the wall, wherein a planer shape of the seal member filling layer is formed to be larger than a shape of an opening of the inserting hole, wherein the seal member filling layer is capable of filling the seal member for covering the respective press contact blades, and wherein the seal member is filled up to the inserting hole.

6. A waterproof connector comprising:

a housing provided with a plurality of inserting holes;

a plurality of connecting terminals respectively inserted into the inserting holes, each connecting terminal having a press contact blade provided at one end portion thereof and an electric contact portion provided at the other end thereof;

a rear cover attached to the housing to cover the respective press contact blades; and a seal member filling layer provided at at least one of the housing and the rear cover;

wherein the seal member filling layer is capable of filling the seal member for covering the respective press contact blades, and wherein the rear cover includes a main body portion formed with an opening hole and mounted to the housing and a lid member fitted to the opening hole for closing the opening hole, and the seal member is made to be able to fill from the opening hole to the seal member filling layer.

7. The waterproof connector according to claim 6, wherein the lid member of the rear cover is provided with a seal member injecting hole for filling the seal member to the seal member filling layer.

8. A waterproof connector comprising:

a housing provided with a plurality of inserting holes;

a plurality of connecting terminals respectively inserted into the inserting holes, each connecting terminal having a press contact blade provided at one end portion thereof and an electric contact portion provided at the other end thereof;

a rear cover attached to the housing to cover the respective press contact blades; and a seal member filling layer provided at at least one of the housing and the rear cover;

wherein the seal member filling layer is capable of filling the seal member for covering the respective press contact blades, and wherein the seal member is foamed urethane.

* * * * *